US007196667B2

(12) United States Patent
Watada et al.

(10) Patent No.: US 7,196,667 B2
(45) Date of Patent: Mar. 27, 2007

(54) SURFACE-MOUNT TYPE ANTENNA AND ANTENNA APPARATUS EMPLOYING THE SAME, AND WIRELESS COMMUNICATION APPARATUS

(75) Inventors: Kazuo Watada, Kyoto (JP); Shunichi Murakawa, Kyoto (JP); Akinori Sato, Kyoto (JP); Koji Hamada, Kyoto (JP)

(73) Assignee: Kyocera Corporation, Kyoto (JP)

( * ) Notice: Subject to any disclaimer, the term of this patent is extended or adjusted under 35 U.S.C. 154(b) by 0 days.

(21) Appl. No.: 11/212,491

(22) Filed: Aug. 26, 2005

(65) Prior Publication Data

US 2006/0049990 A1 Mar. 9, 2006

(30) Foreign Application Priority Data

Aug. 26, 2004 (JP) ..... P2004-247515

(51) Int. Cl.
*H01Q 1/24* (2006.01)
*H01Q 1/38* (2006.01)

(52) U.S. Cl. ..... 343/700 MS; 343/702

(58) Field of Classification Search ..... 343/700 MS, 343/702

See application file for complete search history.

(56) References Cited

U.S. PATENT DOCUMENTS

| | | | | |
|---|---|---|---|---|
| 5,748,149 | A * | 5/1998 | Kawahata | 343/700 MS |
| 5,867,126 | A * | 2/1999 | Kawahata et al. | 343/702 |
| 6,130,651 | A | 10/2000 | Yanagisawa et al. | 343/895 |
| 6,300,909 | B1 * | 10/2001 | Tsubaki et al. | 343/700 MS |
| 6,433,745 | B1 | 8/2002 | Nagumo et al. | 343/700 MS |
| 6,600,449 | B2 | 7/2003 | Onaka et al. | 343/700 MS |
| 6,677,902 | B2 * | 1/2004 | Akiyama et al. | 343/700 MS |
| 6,803,881 | B2 * | 10/2004 | Ishihara et al. | 343/700 MS |
| 6,806,832 | B2 * | 10/2004 | Sato et al. | 343/700 MS |
| 6,903,691 | B2 * | 6/2005 | Sato et al. | 343/700 MS |
| 7,026,994 | B2 * | 4/2006 | Ikuta et al. | 343/700 MS |
| 2004/0125032 | A1 | 7/2004 | Ikuta, et al. | |

(Continued)

FOREIGN PATENT DOCUMENTS

| | | |
|---|---|---|
| JP | 11-317612 | 11/1999 |

(Continued)

OTHER PUBLICATIONS

Korean Language Office Action for Korean Appl. No. 2005-79053 lists the references cited above.

*Primary Examiner*—Tan Ho
(74) *Attorney, Agent, or Firm*—Hogan & Hartson LLP

(57) ABSTRACT

A surface-mount type antenna includes a rectangular-parallelepiped base body made of a dielectric or magnetic material, having a first surface to be placed on a target substrate, second to fifth surfaces that are continuous with the first surface, and a sixth surface located in parallel with the first surface; a ground electrode formed on at least one of the second to fifth surfaces; two radiating electrodes that are continuous with the ground electrode and extend over two or more adjacent surfaces of the second to sixth surfaces; and two feeding electrodes formed on at least one of the second to fifth surfaces so as to be spaced apart circumferentially of the continuum of the second to fifth surfaces to provide the ground electrode in between. The feeding electrode is capacitance-coupled to the radiating electrode for effecting feeding.

15 Claims, 14 Drawing Sheets

U.S. PATENT DOCUMENTS

2004/0263396 A1* 12/2004 Sung ..... 343/702

FOREIGN PATENT DOCUMENTS

| | | |
|---|---|---|
| JP | 2001-298313 | 10/2001 |
| JP | 2001-326519 | 11/2001 |
| JP | 2001-332921 | 11/2001 |
| JP | 2001-332922 | 11/2001 |
| JP | 2002-204120 | 7/2002 |
| JP | 2002-232232 | 8/2002 |
| JP | 2002-314330 | 10/2002 |
| KR | 1020040053768 | 6/2004 |

* cited by examiner

SURFACE-MOUNT TYPE ANTENNA AND ANTENNA APPARATUS EMPLOYING THE SAME, AND WIRELESS COMMUNICATION APPARATUS

BACKGROUND OF THE INVENTION

1. Field of the Invention

The present invention relates to a multiple frequency-adaptable surface-mount type antenna designed for use in mobile communication equipment such as a cellular mobile phone, for allowing signal transmission and reception at two different frequency bands, and also relates to an antenna apparatus and a wireless communication apparatus that employ the surface-mount type antenna.

2. Description of the Related Art

In recent years, wireless communication apparatuses designed for multiple frequency bands, such as cellular mobile phones, have been coming into wider and wider use that are usable, only with a single wireless communication unit, in a plurality of applications including GSM (Global System for Mobile Communications), DCS (Digital Cellular System), PDC (Personal Digital Cellular), PHS (Personal Handyphone System), GPS (Global Positioning System), and Bluetooth System. Moreover, in consideration of carryability, down-sizing has come to be increasingly demanded of a communication terminal for constituting such an apparatus.

Such a widely-used wireless communication apparatus has succeeded in reducing the size by utilizing appropriate surface-mount type antennas of various design.

Now, a description will be given below as to examples of a related art surface-mount type antenna designed for two different frequency bands (hereinafter referred to simply as "2-frequency surface-mount type antenna") and an antenna apparatus incorporating the same, with reference to perspective views shown in FIGS. 12 and 13 and a developed view shown in FIG. 14 (refer to Japanese Unexamined Patent Publication JP-A 2001-298313).

In the 2-frequency surface-mount type antenna 61 shown in FIG. 12, reference numeral 62 denotes a base body having a rectangular-parallelepiped shape, 63 and 64 denote a feeding electrode, and 65 and 66 denote a radiating electrode.

The related 2-frequency surface-mount type antenna 61 becomes able to provide a 2-frequency operation function; that is, becomes able to operate at two different frequencies, by making a change to the lengths of the radiating electrodes 65 and 66. For example, of the two different frequencies, a lower frequency f1 is obtained by increasing the length of the radiating electrode 65, whereas a higher frequency f2 is obtained by decreasing the length of the radiating electrode 66.

In FIG. 13, reference numeral 71 denotes a surface-mount type antenna, which is mounted on a mounting substrate 78 to constitute an antenna apparatus 80. In the surface-mount type antenna 71 shown in FIG. 13, reference numeral 75 denotes a base body having a rectangular-parallelepiped shape; 74 denotes a feeding electrode; and 72 and 73 denote radiating electrodes. In addition, in the mounting substrate 78, reference numeral 77 denotes a feeding terminal, and 76 denotes a ground conductor layer.

The related art surface-mount type antenna 71 becomes able to provide a 2-frequency operation function; that is, becomes able to operate at two different frequencies, by making a change to pitches of the radiating electrodes 72 and 73. On a side of the base body 71, a pitch of the spiral radiating electrode 73 connected to the feeding electrode 74 is made coarse, and a pitch of the spiral radiating electrode 72 connected to the radiating electrode 73 is made dense.

Such a surface-mount type antenna 71 is mounted on a surface of the mounting substrate 78 by connecting the feeding electrode 74 to the feeding terminal 77, whereby 2-frequency antenna apparatus 80 is constituted.

Moreover, in FIG. 14, reference numeral 81 denotes a surface-mount type antenna. In the surface-mount type antenna 81, reference numeral 84 denotes a feeding electrode, 82 and 89 denote a feeding-side radiating electrode, 83 and 87 denote a non-feeding-side radiating electrode, and 88 denotes a ground electrode.

By virtue of adaptability of the feeding-side radiating electrodes 82 and 89 to higher-order mode frequencies and arrangement of the non-feeding-side radiating electrodes 83 and 87 and a branch electrode as well, the related surface-mount type antenna 81 becomes able to provide a multi-frequency operation function; that is, becomes able to operate at a plurality of different frequencies. It is thus necessary to provide the radiating electrodes 83 and 87, as a current flowing path of different electrical length, other than the feeding-side radiating electrodes 82 and 89.

In addition, as a multiple frequency-adaptable antenna, for example, there is disclosed an antenna for a mobile communication terminal that is adapted to be used in plural frequency bands including frequency bands different from a predetermined frequency band by connecting a grounded capacity of an antenna element to the antenna element for the predetermined frequency band to change a value of the predetermined frequency band (refer to Japanese Unexamined Patent Publication JP-A 2002-232232). According to this disclosure, since it is necessary to insert a switch in series in a transmission path for switching transmission and reception signals, a problem of a signal transmission loss is caused.

In addition, the related 2-frequency surface-mount type antenna 61 as shown in FIG. 12 poses the following problems. In this construction, the feeding electrodes are two in number and are disposed independently of each other, and so are the radiating electrodes. This configuration, although it is advantageous in easiness of frequency adjustment and matching control, makes miniaturization difficult.

Furthermore, even if the dielectric constant of the base body 62 is increased, and the radiating electrode is shortened by exploiting a short wavelength effect in an attempt to make the antenna compact, due to the occurrence of intense mutual electromagnetic-field interference between the radiating electrodes 65 and 66, the antenna characteristics are deteriorated.

In addition, the related surface-mount type antenna 71 shown in FIG. 13 poses the following problems. In this construction, in order to match an operation frequency of the surface-mount type antenna 71 to a lower frequency f1 and a higher frequency f2 of a radio signal used in a communication system, it is necessary to adjust lengths and pitches (spacings) of the spiral radiating electrodes 72 and 73, and the adjustment requires many labor hours.

Furthermore, in the case of using only one feeding electrode, there arises significant mutual interference between signals of two different frequencies. Eventually, the signals turn into sources of noise with respect to each other.

In addition, there also arises the following problem. When it is attempted to increase a dielectric constant of the base body 75 to reduce a size of the surface-mount type antenna 71, since an unnecessary resonance mode occurs unexpectedly between the spiral long radiating electrodes 72 and 73 and the ground conductor layer 76, and stable antenna characteristics adaptable to two frequencies is not obtained, it is difficult to reduce a size of the surface-mount type antenna 71.

Further, in the antenna element disclosed in JP-A 2002-204120, there arises a problem that it is difficult to apply surface mounting to a mounting substrate.

The surface-mount type antenna 81 disclosed in JP-A 2001-298313 as shown in FIG. 14 also poses the following problems. In order to achieve multiple-frequency antenna operation, in the surface-mount type antenna 81, the non-feeding-side radiating electrodes 83 and 87 are provided as a current flowing path of different electrical length by means of electrode branching technique. By virtue of the non-feeding-side radiating electrodes 83 and 87, the multiple-frequency antenna operation can be achieved. However, in general, a non-feeding side electrode is placed in the proximity of a feeding side electrode, and thus it may be able to function as an antenna on its own by exploiting an electromagnetic field generated at the feeding side electrode. It is therefore inevitable that mutual electromagnetic-field interference takes place between the feeding side electrodes and non-feeding side electrodes. Moreover, the non-feeding-side radiating electrodes 83 and 87 are so formed as to exhibit a branched structure with respect to a single ground electrode 88 (non-feeding electrode, as exemplified). This makes it difficult to strike a proper balance of matching between the non-feeding-side radiating electrodes 83 and 87. Moreover, the non-feeding-side radiating electrodes 83 and 87 are so formed as to exhibit a branched structure with respect to a single ground electrode 88 (non-feeding electrode, as exemplified). This makes it difficult to strike a proper balance of matching between the non-feeding-side radiating electrodes 83 and 87. That is, since in the surface-mount type antenna 81, the radiating electrodes 83, 87 are formed to exhibit a branched structure in order to make it possible to respond to plural frequencies with a single feeding terminal, it is difficult to achieve impedance matching in each of the blanched radiating electrodes.

Furthermore, the feeding-side radiating electrodes 82 and 89 are adaptable to two frequencies: a fundamental frequency and a higher-order mode frequency. In order to make frequency adjustment on an individual basis, the electrode is designed to vary in breadth from part to part. In the surface-mount type antenna 81, frequency adjustment is made with respect to the fundamental frequency and the higher-order mode frequency by narrowing a certain part of the electrode pattern. However, further additional frequency adjustment cannot be achieved without changing the electrode pattern. This makes frequency adjustment extremely difficult. With regard to this it may be conceivable that frequency adjustment can be made by widening the electrode pattern in part. In the surface-mount type antenna 81, however, if its electrode pattern is partially widened, at the time of trimming in the widened portion of the pattern, there will be a change in the current flowing path inconveniently. This makes delicate frequency adjustment difficult.

SUMMARY OF THE INVENTION

The invention has been devised in view of the above-described problems with the related art, and accordingly its object is to provide a multiple frequency-adaptable surface-mount type antenna that is compact and offers satisfactory antenna characteristics with stability, and that is excellent in easiness of frequency adjustment and matching control, and succeeds in reducing undesirable mutual interference to a minimum, and also provide an antenna apparatus and a wireless communication apparatus that employ said surface-mount type antenna.

The invention provides a surface-mount type antenna comprising:

a base body, formed of a dielectric or magnetic material in the shape of a rectangular parallelepiped, having a first surface to be placed on a target substrate, and second, third, fourth, and fifth surfaces that are continuous with the first surface, and a sixth surface located in parallel with the first surface;

a ground electrode formed on, of the second to sixth surfaces of the base body, at least one of the second to fifth surfaces;

two pieces of radiating electrodes that are continuous with the ground electrode, each of which is so formed as to extend over two or more adjacent surfaces of the second to sixth surfaces; and two pieces of feeding electrodes formed on at least one of the second to fifth surfaces in such a way as to be spaced apart circumferentially of the continuum of the second to fifth surfaces to provide the ground electrode in between, the feeding electrodes being capacitance-coupled to the two radiating electrodes, respectively, for effecting feeding thereto.

According to the invention, in the base body formed of a dielectric or magnetic material in the shape of a rectangular parallelepiped is formed the ground electrode on at least one of the second to fifth surfaces of the base body that are continuous with the first surface to be placed on the surface of a target substrate. The two radiating electrodes extend continuously from the ground electrode. By configuring the two radiating electrodes in such a way as to be connected to a single, common ground electrode, in contrast to the case of providing the ground electrode separately for the individual radiating electrodes, it is possible to reduce the surface area of the base body necessary to form the radiating electrodes and the common ground electrode. As a consequence, the base body can be made compact, which leads to down-sizing of the apparatus as a whole.

In accompaniment with miniaturization of the base body to reduce the size of the apparatus as a whole, the feeding electrodes are inevitably arranged in the proximity of each other. With regard to this, the feeding electrodes are formed on at least one of the second to fifth surfaces in such a way as to be spaced apart circumferentially of the continuum of the second to fifth surfaces to provide the ground electrode in between. In this way, variations in the electromagnetic field generated at one of the feeding electrodes propagate through the surface of base body so as to pass through the ground electrode before reaching the other feeding electrode. This helps suppress unwanted transmission of electromagnetic field, and thereby reduce mutual interference between the two feeding electrodes. Moreover, by virtue of the ground electrode, it is possible to minimize mutual interference between the two feeding electrodes, and thereby increase the placement flexibility for the feeding electrodes on the second to fifth surfaces.

Moreover, the radiating electrodes are so configured as to extend over two or more adjacent surfaces of the second to sixth surfaces; that is, they are configured in a three-dimensional manner. This helps increase the cubic volume of that part of the antenna which is responsible for radio-wave transmission or reception. Antenna characteristics such as transmission efficiency, reception efficiency, gain, and frequency bandwidth are enhanced in proportion to the size of the antenna, namely, the cubic volume of that part of the antenna which is responsible for radio-wave transmission or reception. In light of this fact, such a configuration is desirable in terms of enhancement of transmission efficiency, reception efficiency, and gain, and widening of frequency bandwidth in the surface-mount type antenna of the invention.

Moreover, both the ground electrode and the feeding electrode are formed on at least one of the second to fifth surfaces that are continuous with the first surface. In this way, at the time of mounting the surface-mount type antenna on a target mounting substrate with the first surface facing with the mounting substrate, the ground electrode and the feeding electrode are each located in the proximity of the mounting substrate. Therefore, not only it is possible to facilitate connection of the ground electrode, the feeding electrode and their corresponding regions of the mounting substrate, but it is also possible to reduce the length of the connection line between the ground electrode, the feeding electrode and their corresponding regions of the mounting substrate. As a consequence, occurrence of noise can be prevented in the connection line.

Further, the two radiating electrodes extend continuously from the ground electrode. Specifically, in the two radiating electrodes, the base end is connected to the ground electrode, whereas the free end opposite to the base end is formed into an open end. Therefore, in the two radiating electrodes, by subjecting the free ends to trimming, it is possible to facilitate adjustment of frequencies corresponding to transmission or reception in the radiating electrodes. Further, the two feeding electrodes are capacitance-coupled to the two radiating electrodes, respectively. That is, one of the two feeding electrodes is capacitance-coupled to one of the two radiating electrodes, whereas the other feeding electrode is capacitance-coupled to the other radiating electrode. Since the feeding electrodes are provided so as to correspond to the respective radiating electrodes branched from the ground electrode, and the respective feeding electrodes are capacitance-coupled to the corresponding radiating electrodes, adjustment of impedance matching can be achieved simply by changing the degree of capacitance coupling between the feeding electrode and the radiating electrode, or by changing at least one of the distance between the feeding electrode and the radiating electrode and the areas of the feeding electrode and the radiating electrode by means of trimming or the like method.

Besides, at the time of performing transmission and reception by means of the surface-mount type antenna of the invention, there is no need to insert a switch for allowing selection between a transmission signal and a reception signal in series with the transmission path for transmission and reception signals, in consequence whereof there results no problem of signal transmission loss. It is thus possible to realize a surface-mount type antenna that is adaptable to multiple frequencies.

In the invention, it is preferable that the feeding electrodes are formed on a surface of the second to fifth surfaces, on which surface the ground electrode is formed.

According to the invention, the two feeding electrodes are formed on the surface of the second to fifth surfaces, on which surface the ground electrode is formed. In this case, the two feeding electrodes do not confront each other in a surface-wise manner. This helps suppress mutual interference between the two feeding electrodes.

In the invention, it is preferable that the feeding electrodes are respectively arranged at both ends in opposite directions away from the ground electrode.

According to the invention, the two electrodes are arranged at both ends in opposite directions away from the ground electrode. In this case, as large a spacing as possible can be secured between the two feeding electrodes. This helps reduce mutual interference between the two feeding electrodes to a minimum.

In the invention, it is preferable that the feeding electrodes are formed on different surfaces of the second to fifth surfaces that are adjacent to each other.

According to the invention, the feeding electrodes are formed on different surfaces of the second to fifth surfaces that are adjacent to each other. In this case, the feeding electrodes do not confront each other in a surface-wise manner. This helps suppress mutual interference between the two feeding electrodes.

In the invention, it is preferable that the feeding electrodes are formed on different surfaces that are adjacent to each other, of which one feeding electrode is arranged at one end of its corresponding surface, the one end being non-adjacent to the surface to which the other feeding electrode belongs, and the other feeding electrode is arranged at one end of its corresponding surface, the one end being non-adjacent to the surface to which the one feeding electrode belongs.

According to the invention, the feeding electrodes are formed on different surfaces of the second to fifth surfaces that are adjacent to each other. More specifically, one of the feeding electrodes is formed at one end of its corresponding surface which one end is non-adjacent to the surface to which the other feeding electrode belongs, and the other feeding electrode is formed at one end of its corresponding surface which one end is non-adjacent to the surface to which the one feeding electrode belongs. In this case, as large a spacing as possible can be secured between the two feeding electrodes. This helps reduce mutual interference to a minimum between the two feeding electrodes of those are formed on different surfaces of the second to fifth surfaces that are adjacent to each other.

In the invention, it is preferable that the feeding electrodes are formed on different surfaces of the second to fifth surfaces that confront each other in a direction longitudinally of the base body.

According to the invention, the feeding electrodes are formed on different surfaces of the second to fifth surfaces that confront each other in a direction longitudinally of the base body. In this case, although the two feeding electrodes are formed so as to confront each other in a surface-wise manner, by virtue of the arrangement of the feeding electrodes respectively formed on both end surfaces along the longitudinal direction of the base body, a sufficient spacing can be secured between the two opposed feeding electrodes. This helps suppress mutual interference between the two feeding electrodes. Since as large a spacing as possible can be secured between the two feeding electrodes, mutual interference can be minimized, whereby making it possible to increase the placement flexibility for the feeding electrodes formed on the end faces of the base body that confront each other in a direction longitudinally of the base body.

In the invention, it is preferable that the feeding electrodes are formed on different surfaces of the second to fifth surfaces that are parallel to each other in such a manner as not to confront each other.

According to the invention, the feeding electrodes are formed on different surfaces of the second through fifth surface that are parallel to each other in such a manner as not to confront each other. In this case, since there is no direct confrontation of the two feeding electrodes, mutual interference can be suppressed between the feeding electrodes.

In the invention, it is preferable that the two radiating electrodes have free ends thereof which are opposed to each other.

According to the invention, the two radiating electrodes have free ends thereof opposed to each other. In a sense, the radiating electrodes can be regarded as each other's parts (capacitance feeding), like a single radiating electrode. From such a perception, the radiating electrode is essentially allowed to have a longer electrical length. This helps reduce the size of the antenna as a whole. Note that the two radiating electrodes are so designed that they can be regarded as each other's parts only in terms of resonant frequency.

In the invention, it is preferable that the two radiating electrodes have free ends thereof opposed to each other, in such a way as to be spaced apart to provide the ground electrode in between.

According to the invention, the two radiating electrodes have free ends thereof opposed to each other, with the ground electrode lying therebetween. In this case, since electric current and voltage distributions of the ground electrode differs in phase from those of the two radiating electrodes, mutual interference between the two radiating electrodes can be reduced to a minimum.

In the invention, it is preferable that, of the two radiating electrodes, one radiating electrode has its free end placed on one of the two parallely-arranged surfaces of the second to fifth surfaces, and the other radiating electrode has its free end placed on the other one of the two parallely-arranged surfaces.

According to the invention, of the two radiating electrodes, one radiating electrode has its free end placed on one of the two parallely-arranged surfaces of the second to fifth surfaces, and the other radiating electrode has its free end placed on the other one of the two parallely-arranged surfaces. In this case, since a sufficient spacing can be secured between the free ends of the two radiating electrodes, mutual interference can be suppressed between the two radiating electrodes.

In the invention, it is preferable that the base body has at least one of a through hole and a groove formed therein.

According to the invention, the base body has at least one of a through hole and a groove formed therein. This helps reduce the weight of the base body while maintaining satisfactory antenna characteristics, and thus the surface-mount type antenna can be made highly reliable in terms of structural strength against an impact which occurs after mounting is completed.

The invention provides an antenna apparatus comprising:

the surface-mount type antenna mentioned above; and a mounting substrate, made of a basic substance possessing an electrical insulation property, having two feeding terminals and a ground conductor layer formed on a top surface of the basic substance, the two feeding terminals being placed in correspondence with the positions of the two feeding electrodes of the surface-mount type antenna, respectively, and the ground conductor layer being arranged on one side of the top surface opposite to the other side thereof on which the surface-mount type antenna is mounted, namely, a mounting region, in the vicinity of the two feeding terminals, with a spacing secured between the ground conductor layer and the feeding terminals, wherein the antenna apparatus is constructed by mounting the surface-mount type antenna mentioned aboveon the mounting substrate with the first surface of the surface-mount type antenna facing with the mounting region, with the two feeding electrodes connected to their corresponding feeding terminals, and with the ground electrode connected to the ground conductor layer.

According to the invention, the antenna apparatus includes one of the surface-mount type antennas of the invention. Thereby, the wireless communication apparatus operates as a multiple frequency-adaptable communication apparatus that is free from degradation of antenna characteristics caused by mutual interference between the two feeding electrodes or is free from degradation of antenna characteristics caused by mutual interference between the two feeding electrodes and mutual interference between the two radiating electrodes as well, is excellent in easiness of frequency adjustment and matching control, and is highly reliable in terms of mounting strength.

Being placed in correspondence with the positions of the two feeding electrodes, the two feeding terminals can readily be connected to the two feeding electrodes, respectively, of the surface-mount type antenna to be mounted. Moreover, since the ground conductor layer is arranged on one side of the top surface of the mounting substrate opposite to the mounting region thereof in the vicinity of the two feeding terminals; that is, the ground conductor layer is formed over as large an area as possible, the placement flexibility for the ground electrode can be increased in the surface-mount type antenna.

The invention provides an antenna apparatus comprising:

the surface-mount type antenna mentioned above; and a mounting substrate, made of a basic substance possessing an electrical insulation property, having two feeding terminals and a ground conductor layer formed on a top surface of the basic substance, the two feeding terminals being placed in correspondence with the positions of the two feeding electrodes of the surface-mount type antenna, respectively, and the ground conductor layer being formed so as to surround spacedly the two feeding terminals, wherein the antenna apparatus is constructed by stacking the surface-mount type antenna mentioned above on the mounting substrate with the first surface of the surface-mount type antenna facing with the ground conductor layer, with the two feeding electrodes connected to their corresponding feeding terminals, and with the ground electrode connected to the ground conductor layer.

According to the invention, the antenna apparatus includes one of the surface-mount type antennas of the invention. Thereby, the wireless communication apparatus operates as a multiple frequency-adaptable communication apparatus that is free from degradation of antenna characteristics caused by mutual interference between the two feeding electrodes or is free from degradation of antenna characteristics caused by mutual interference between the two feeding electrodes and mutual interference between the two radiating electrodes as well, is excellent in easiness of frequency adjustment and matching control, and is highly reliable in terms of mounting strength.

Moreover, at the time of mounting the surface-mount type antenna on the mounting substrate, the surface-mount type antenna is superposed on the ground conductor layer around which the feeding terminals are formed. Therefore, the ground electrode of the surface-mount type antenna can readily be connected to the ground conductor layer wherever it is arranged; that is, on any surface from the second to fifth surfaces. This helps increase the placement flexibility for the ground electrode.

The invention provides a wireless communication apparatus comprising:

the antenna apparatus mentioned above; and at least one of a transmission circuit and a reception circuit designed for radio signals in a desired range of frequencies, the transmission circuit and/or the reception circuit being connected to the two feeding terminals.

According to the invention, in the wireless communication apparatus, at least one of a transmission circuit and a reception circuit designed for radio signals in a desired range of frequencies is connected to the two feeding terminals of the antenna apparatus of the invention. Thereby, the wireless communication apparatus operates as a multiple frequency-adaptable communication apparatus that is free from degradation of antenna characteristics caused by mutual interference between the two feeding electrodes or is free from degradation of antenna characteristics caused by mutual interference between the two feeding electrodes and mutual interference between the two radiating electrodes as well, is excellent in easiness of frequency adjustment and matching control, and is highly reliable in terms of mounting strength.

As described heretofore, according to the invention, it is possible to provide multiple frequency-adaptable surface-mount type antenna and antenna apparatus as well as wireless communication apparatus employing the surface-mount type antenna that are free from degradation of antenna characteristics caused by mutual interference between the two feeding electrodes or are free from degradation of antenna characteristics caused by mutual interference between the two feeding electrodes and mutual interference between the two radiating electrodes as well, is excellent in easiness of frequency adjustment and matching control, and is highly reliable in terms of mounting strength.

BRIEF DESCRIPTION OF THE DRAWINGS

Other and further objects, features, and advantages of the invention will be more explicit from the following detailed description taken with reference to the drawings wherein.

DETAILED DESCRIPTION

Figure 1A:
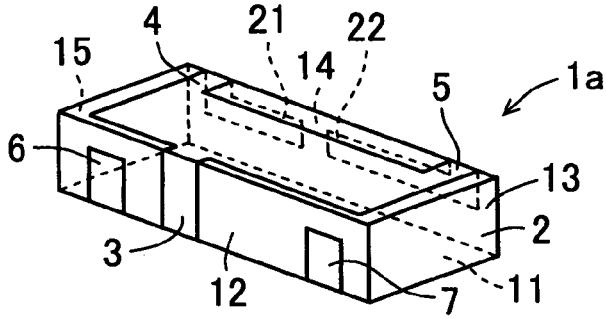
FIGS. 1A through 1E are perspective views each showing surface-mount type antennas according to respective embodiment of the invention.

Now referring to the drawings, preferred embodiments of the invention are described below.

Embodiments of a surface-mount type antenna and an antenna apparatus as well as a wireless communication apparatus employing the surface-mount type antenna of the invention will be hereinafter explained with reference to the accompanying drawings.

Figure 1B:
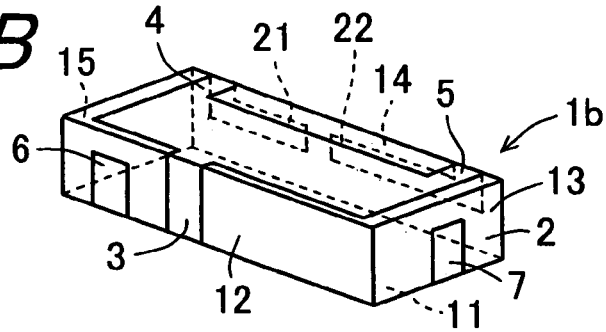
Figure 1C:
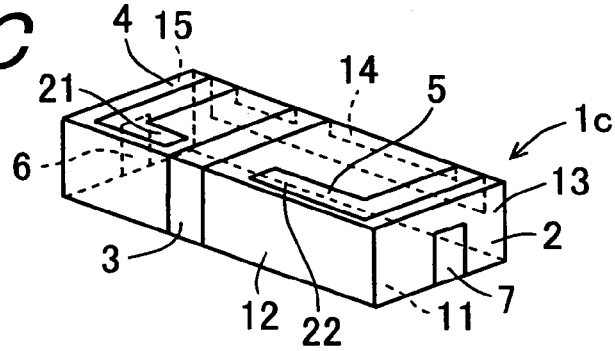
Figure 1D:
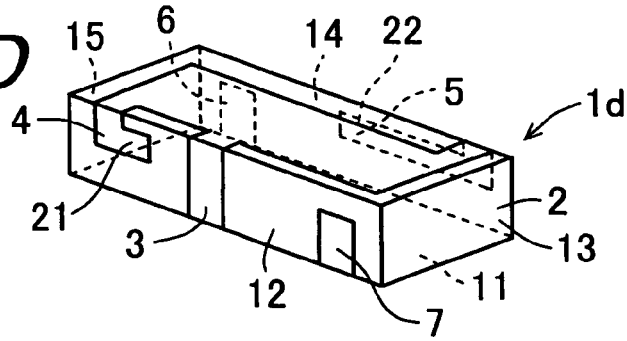
Figure 1E:
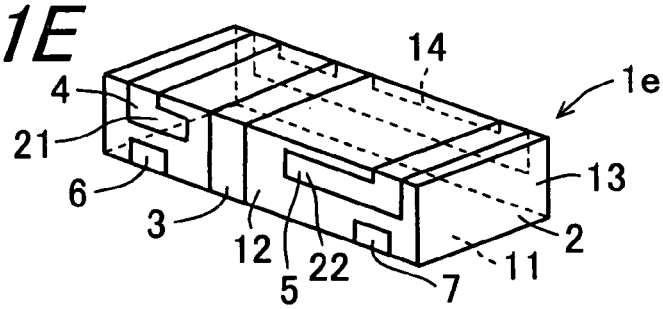

FIGS. 1A through 1E are perspective views showing surface-mount type antennas 1*a* to 1*e* according to a respective embodiment of the invention. FIG. 1A is a perspective view showing the surface-mount type antenna 1*a* implemented as the first embodiment of the invention. FIG. 1B is a perspective view showing the surface-mount type antenna 1*b* implemented as the second embodiment of the invention. FIG. 1C is a perspective view showing the surface-mount type antenna 1*c* implemented as the third embodiment of the invention. FIG. 1D is a perspective view showing the surface-mount type antenna 1*d* implemented as the fourth embodiment of the invention. FIG. 1E is a perspective view showing the surface-mount type antenna 1*e* implemented as the fifth embodiment of the invention. Hereinafter, there may be cases where the surface-mount type antenna 1*a* implemented as the first embodiment of the invention will be referred to as "the first surface-mount type antenna 1*a*". Likewise, there may be cases where the surface-mount type antenna 1*b* implemented as the second embodiment of the invention will be referred to as "the second surface-mount type antenna 1*b*"; the surface-mount type antenna 1*c* implemented as the third embodiment of the invention will be referred to as "the third surface-mount type antenna 1*c*"; the surface-mount type antenna 1*d* implemented as the fourth embodiment of the invention will be referred to as "the fourth surface-mount type antenna 1*d*"; and the surface-mount type antenna 1*e* implemented as the fifth embodiment of the invention will be referred to as "the fifth surface-mount type antenna 1*e*.

There may be cases where the first to fifth surface-mount type antennas 1*a* to 1*e* together, or unspecified one of them, will be referred to simply as "the surface-mount type antenna 1".

Each of the surface-mount type antennas 1 (designated by 1*a* through 1*e* in FIGS. 1A through 1E, respectively) embodying the invention is composed of a base body 2, a ground electrode 3, two pieces of radiating electrodes 4 and 5, and two pieces of feeding electrodes 6 and 7. Hereinafter, there may be cases where the two radiating electrodes 4 and 5 will be referred to as "the first radiating electrode 4" and "the second radiating electrode 5", respectively. Likewise, there may be cases where the two feeding electrodes 6 and 7 will be referred to as "the first feeding electrode 6" and "the second feeding electrode 7", respectively. Such constituent components as are common to the respective surface-mount type antennas 1 are denoted by the same reference designations.

The base body 2, which is formed of a dielectric or magnetic material in the shape of a rectangular parallelepiped, has a first surface 11 to be placed on one surface of a target substrate; second, third, fourth, and fifth surfaces 12, 13, 14, and 15 that are continuous with the first surface 11; and a sixth surface 16 that is continuous with the second to fifth surfaces 12 to 15. The first surface 11 and the sixth surface 16 are located in parallel with each other. In the surface-mount type antennas 1*a* to 1*e* respectively implemented as the first to fifth embodiments, the first to sixth surfaces 11 to 16 are each shaped as a plane surface. The second and fourth surfaces 12 and 14 are parallely arranged, so are the third and fifth surfaces 13 and 15. In these embodiments, the second and fourth surfaces 12 and 14 are made larger than the third and fifth surfaces 13 and 15. The dielectric material for use in forming the base body 2 is selected from among materials possessing appropriate dielectric properties, namely, electrical insulation properties. A magnetic material possessing electrical insulation properties may also be used as a magnetic material for the base body 2.

The ground electrode 3 is formed on, of the second to sixth surfaces 12, 13, 14, 15, and 16, at least one of the second to fifth surfaces 12, 13, 14, and 15.

The first and second radiating electrodes 4 and 5 are, at their base ends, continuous with the ground electrode 3, and are each so configured as to extend over two or more adjacent surfaces of the second to sixth surfaces 12, 13, 14, 15, and 16. The first and second radiating electrodes 4 and 5 have their free ends 21 and 22 formed into open ends.

The first and second feeding electrodes 6 and 7 are formed on at least one of the second to fifth surfaces 12, 13, 14, and 15 so as to be spaced apart circumferentially of the continuum of the second to fifth surfaces 12, 13, 14, and 15, with the ground electrode 3 lying therebetween. Moreover, the first and second feeding electrodes 6 and 7 are capacitance-coupled to the first and second radiating electrodes 4 and 5, respectively. The first feeding electrode 6 is capacitance-coupled to the first radiating electrode 4 for performing feeding thereto. The second feeding electrode 7 is capacitance-coupled to the second radiating electrode 5 for performing feeding thereto. Note that the ground electrode 3 is interposed in a closer spacing between the first and second feeding electrodes 6 and 7, when viewed in the circumferential direction of the continuum of the second to fifth surfaces.

Hereinafter, more details of the first to fifth surface-mount type antennas 1*a* to 1*e* will be explained.

Figure 2A:
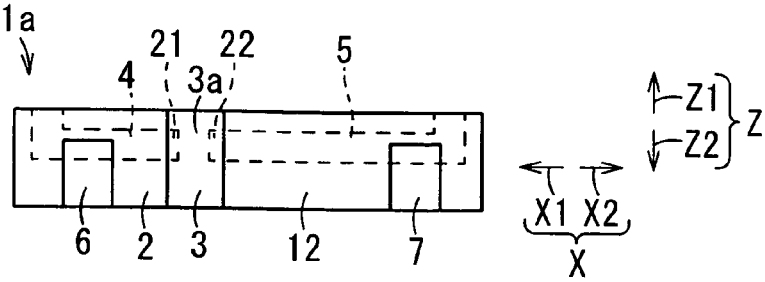
FIGS. 2A through 2F are six-side views showing a structure of a surface-mount type antenna according to a first embodiment of the invention.
Figure 2B:
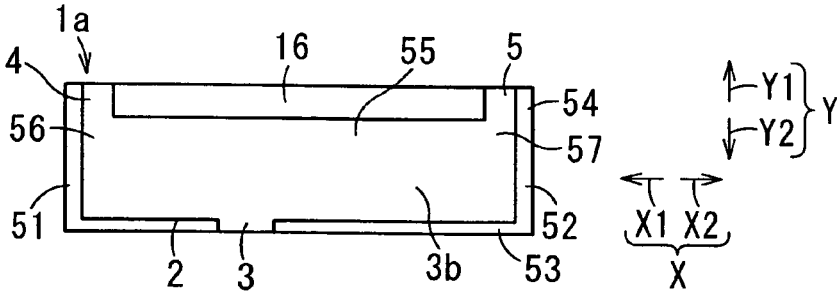
Figure 2C:
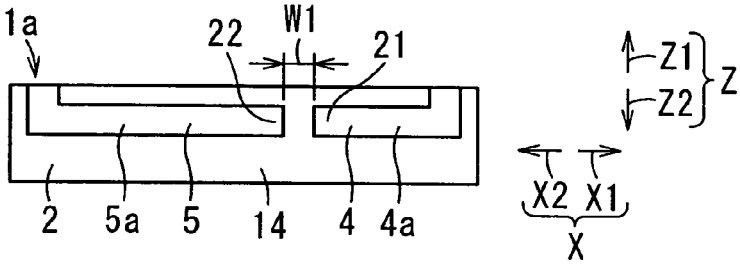
Figure 2D:
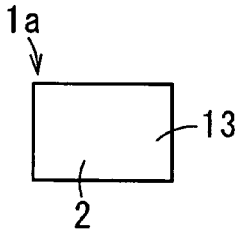
Figure 2E:
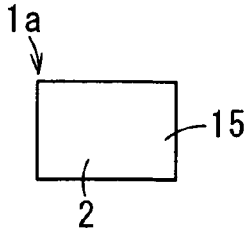
Figure 2F:
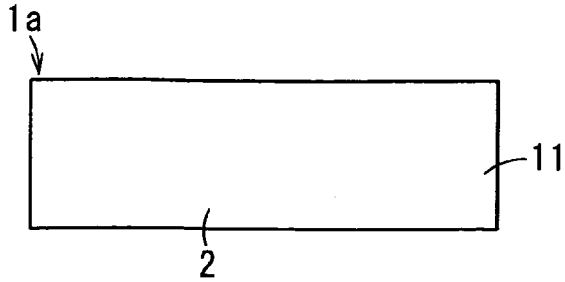

FIGS. 2A to 2F are six-side views showing the structure of the first surface-mount type antenna 1*a*. FIG. 2A is a front view of the first surface-mount type antenna 1*a*; FIG. 2B is a plan view thereof; FIG. 2C is a rear view thereof; FIG. 2D is a right-hand side view thereof; FIG. 2E is a left-hand side view thereof; and FIG. 2F is a bottom view thereof.

A direction perpendicular to the first and sixth surfaces 11 and 16 is defined as a thicknesswise direction Z. A direction perpendicular to the second and fourth surfaces 12 and 14 is defined as a transverse direction Y. A direction perpendicular to the third and fifth surfaces 13 and 15 is defined as a longitudinal direction X. For example, the longitudinal direction X-wise dimension of the base body 2 is set to fall in a range of 5 mm or more and less than 30 mm. The transverse direction Y-wise dimension thereof is set to fall in a range of 1 mm or more and less than 10 mm. The thicknesswise direction Z-wise dimension thereof is set to fall in a range of 0.5 mm ore more and less than 8 mm.

In the first surface-mount type antenna 1*a*, the ground electrode 3 is so formed as to extend over the second and sixth surfaces 12 and 16. That part of the ground electrode 3 which lies on the second surface 12, namely, the ground electrode portion 3*a*, has a quadrilateral shape. When viewed in the longitudinal direction X, the ground electrode portion 3*a* is arranged on the longitudinal direction X1-wise side of the second surface 12 relative to the midsection thereof. The ground electrode portion 3*a* extends from one end to the other end of the second surface 12 in the thicknesswise direction Z. The longitudinal direction X-wise dimension of the ground electrode portion 3*a* formed on the second surface 12 depends on the to-be-given resonant frequency, but is set to fall in a range of, for example, 0.1 mm or more and 3.0 mm or less. When the longitudinal direction X-wise dimension of the ground electrode portion 3*a* formed on the second surface 12 is less than 0.1 mm, there is a possibility of disconnection, and a risk of causing a variation in the antenna characteristics due to a variation in the dimensions. In addition, when the longitudinal direction X-wise dimension of the ground electrode portion 3*a* formed on the second surface 12 exceeds 3.0 mm, the antenna will grow in size. Consequently, by selecting the longitudinal direction X-wise dimension of the ground electrode portion 3*a* formed on the second surface 12 so as to fall in a range of 0.1 mm or more and 3.0 mm or less, the variation in the antenna characteristics can be suppressed, and the antenna can be prevented from growing in size.

When viewed in the transverse direction Y, that part of the ground electrode 3 which lies on the second surface 12, namely, the ground electrode portion 3*a*, is arranged face to face with the free ends 21 and 22 of the first and second radiating electrodes 4 and 5 formed on the fourth surface 14. That is, the ground electrode portion 3*a* is opposed to the free ends 21 and 22 in the transverse direction Y.

The ground electrode 3 extends continuously from the second surface 12 to the sixth surface 16, and extends further, on the sixth surface 16, from one transverse direction Y1 toward the other transverse direction Y2. That part of the ground electrode 3 which lies on the sixth surface 16, namely, the ground electrode portion 3*b* (exclusive of the part acting as the connection with the second surface 12) is so formed as to extend from one end 51 to the other end 52 of the sixth surface 16 in the longitudinal direction X. Strictly speaking, the edges of the sixth surface 16 are substantially free of the ground electrode portion 3*b*. When viewed in the transverse direction Y, the ground electrode portion 3*b* extends from one end 53 to the midsection of the sixth surface 16, and extends further partway to the other end 54 thereof. The ground electrode portion 3*b* formed on the sixth surface 16 has a quadrilateral shape.

At the other transverse direction Y-wise end of the ground electrode portion 3*b* formed on the sixth surface 16, one longitudinal direction X-wise end 56 is continuous with the first radiating electrode 4, whereas the other longitudinal direction X-wise end 57 is continuous with the second radiating electrode 5. The first radiating electrode 4, which is continuous with the ground electrode 3, extends in one transverse direction Y1 toward the fourth surface 14. That part of the first radiating electrode 4 which lies on the fourth surface 14, namely, the first radiating electrode portion 4*a*, is so formed as to extend from one thicknesswise direction Z1 to the other thicknesswise direction Z2 and then turn at a thicknesswise direction Z-wise midpoint of the fourth surface 14 so as to extend further in the other longitudinal direction X2. Likewise, the second radiating electrode 5, which is continuous with the ground electrode 3, extends in one transverse direction Y1 toward the fourth surface 14. That part of the second radiating electrode 5 which lies on the fourth surface 14, namely, the second radiating electrode portion 5*a*, is so formed as to extend from one thicknesswise direction Z1 to the other thicknesswise direction Z2 and then turn at a thicknesswise direction Z-wise midpoint of the fourth surface 14 so as to extend in one longitudinal direction X1.

The extending direction-wise lengths of the first and second radiating electrodes 4 and 5 are determined on the basis of a frequency corresponding to transmission or reception. The extending direction-wise length of the first radiating electrode 4 is made shorter than that of the second radiating electrode 5. In this way, the first radiating electrode 4 constitutes a quarter-wavelength monopole antenna which is adaptable to, of radio signals in a range of frequencies for use in a multiple frequency-adaptable communication apparatus, the one of higher frequency f1, whereas the second radiating electrode 5 constitutes another quarter-wavelength monopole antenna which is adaptable to radio signals of lower frequency f2 for use in the same communication apparatus.

The first and second radiating electrodes 4 and 5 are made equal in width, namely, dimension as viewed in a direction perpendicular to the extending direction and thickness thereof. The dimension depends on the to-be-given resonant frequency, but is set to fall in a range of, for example, 0.1 mm or more and 3.0 mm or less. When the width of the first and second radiating electrodes 4 and 5 is less than 0.1 mm, there is a possibility of disconnection, and a risk of causing a variation in the antenna characteristics due to a variation in the dimensions. In addition, when the width of the first and second radiating electrodes 4 and 5 exceeds 3.0 mm, the antenna will grow in size. Consequently, by selecting the width of the first and second radiating electrodes 4 and 5 so as to fall in a range of 0.1 mm or more and 3.0 mm or less, the variation in the antenna characteristics can be suppressed, and the antenna can be prevented from growing in size.

On the fourth surface 14, the first and second radiating electrodes 4 and 5 have their longitudinal direction X-wise elongated portions arranged in a straight line, so that the free ends 21 and 22 are opposed to each other. A predetermined spacing W1 is secured between the free ends 21 and 22 of the first and second radiating electrodes 4 and 5.

Moreover, the first and second radiating electrode portions 4*a* and 5*a* formed on the fourth surface 14, specifically, the free ends 21 and 22 are arranged, when viewed in the thicknesswise direction Z, on the thicknesswise direction Z1-wise side of the fourth surface 14 relative to the midsection thereof. By virtue of such an arrangement, at the time of mounting the first surface-mount type antenna 1*a* on a mounting substrate with the first surface 11 facing with the mounting substrate, it never occurs that the first and second radiating electrodes 4 and 5 are adversely affected by unwanted radiation from the mounting substrate due to too small a spacing between the mounting substrate and the radiating electrodes.

The first and second feeding electrodes 6 and 7 are formed on the second surface 12 having the ground electrode 3. On the second surface 12, the first and second feeding electrodes 6 and 7 are spaced apart to provide the ground electrode 3 in between. The first feeding electrode 6 is spacedly adjacent to the longitudinal direction X1-wise side of the ground electrode 3 on the second surface 12. The second feeding electrode 7 is spacedly adjacent to the longitudinal direction X2-wise side of the ground electrode 3 on the second surface 12. The first and second feeding electrodes 6 and 7 are arranged substantially at both ends of the second surface 12 in opposite directions away from the ground electrode 3; that is, arranged substantially at the opposed longitudinal direction X-wise ends of the second surface 12. The first and second feeding electrodes 6 and 7 are so formed as to extend from one end to some midpoint of the second surface 12 in the thicknesswise direction Z; that is, extend from the other thicknesswise direction Z2 toward one thicknesswise direction Z1. The first and second feeding electrodes 6 and 7 each have substantially a quadrilateral shape.

As shown in FIG. 2A, when viewed in the transverse direction Y, the first feeding electrode 6 has its one part opposed to the first radiating electrode 4 formed on the fourth surface 14, and likewise the second feeding electrode 7 has its one part opposed to the second radiating electrode 5 formed on the fourth surface 14.

In the first surface-mount type antenna la, the first, third, and fifth surfaces 11, 13, and 15 are free from any of the ground electrode 3, the first and second radiating electrodes 4 and 5, and the first and second feeding electrodes 6 and 7.

Figure 3A:
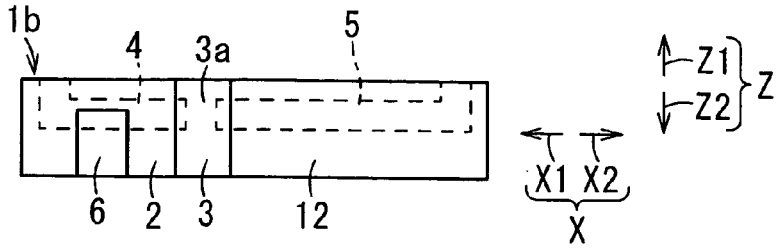
FIGS. 3A through 3F are six-side views showing a structure of a surface-mount type antenna according to a second embodiment of the invention.
Figure 3B:
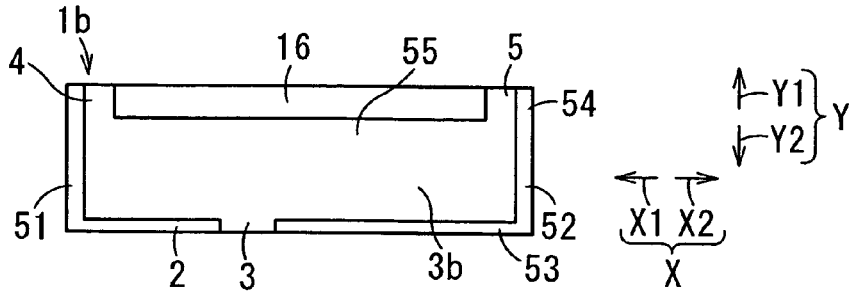
Figure 3C:
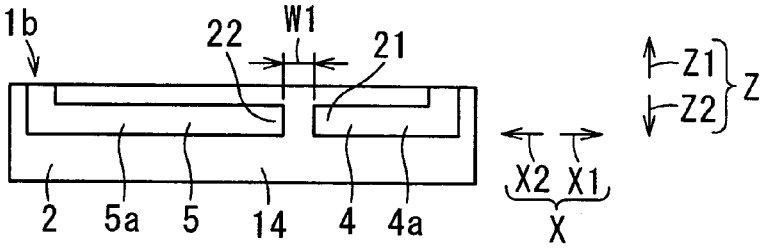
Figure 3D:
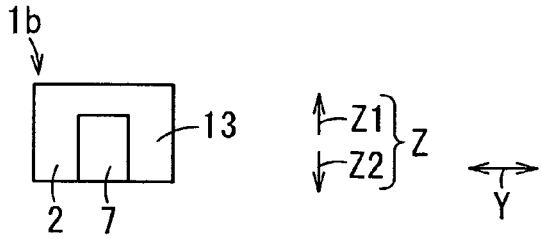
Figure 3E:
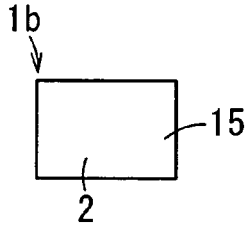
Figure 3F:
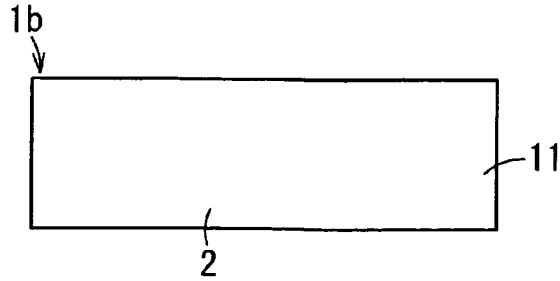

FIGS. 3A to 3F are six-side views showing the structure of the second surface-mount type antenna 1*b*. FIG. 3A is a front view of the second surface-mount type antenna 1*b*; FIG. 3B is a plan view thereof; FIG. 3C is a rear view thereof; FIG. 3D is a right-hand side view thereof; FIG. 3E is a left-hand side view thereof; and FIG. 3F is a bottom view thereof.

The second surface-mount type antenna 1*b* has basically the same structure as the above-described first surface-mount type antenna 1*a*, the only difference being the position of the second feeding electrode 7. Therefore, only the different point will be explained and overlapping descriptions will be omitted. In the second surface-mount type antenna 1*b*, the second feeding electrode 7 is formed on the third surface 13 instead of the second surface 12. The second feeding electrode 7 is formed in the midsection of the third surface 13 as viewed in the transverse direction Y. When viewed in the thicknesswise direction Z, the second feeding electrode 7 extends from one end to some midpoint of the third surface 13; that is, extends from the other thicknesswise direction Z2 toward one thicknesswise direction Z1.

Figure 4A:
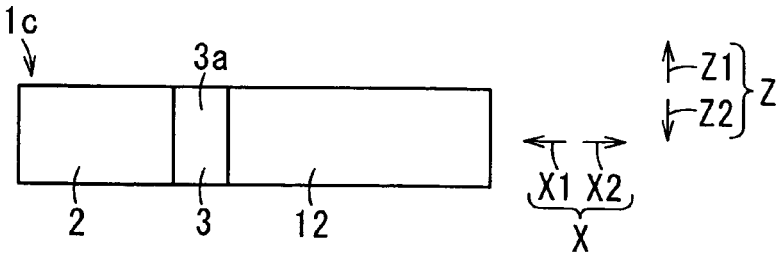
FIGS. 4A through 4F are six-side views showing a structure of a surface-mount type antenna according to a third embodiment of the invention.
Figure 4B:
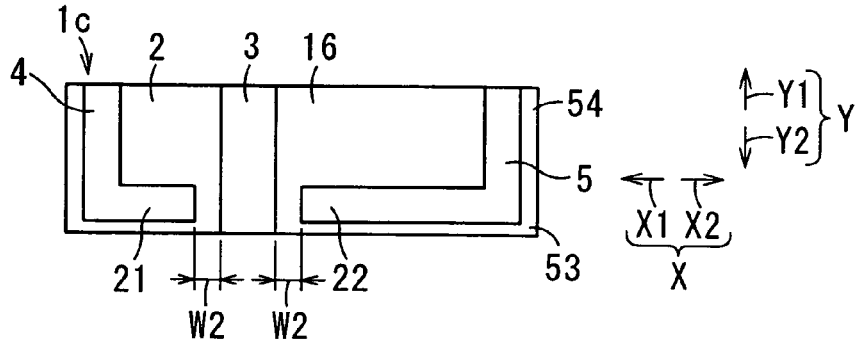
Figure 4C:
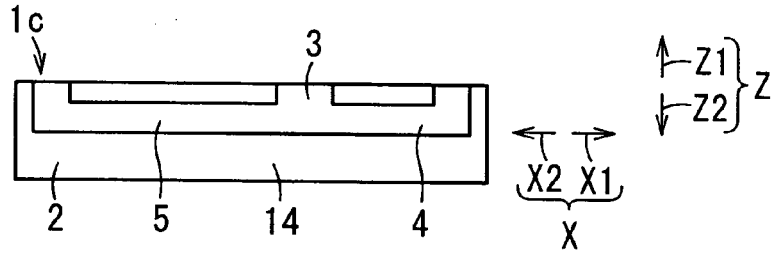
Figure 4D:
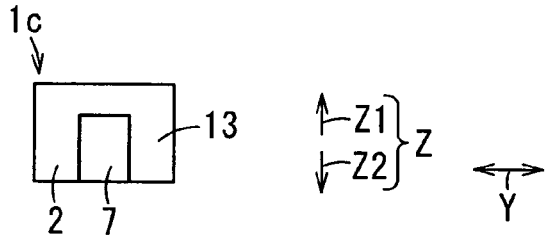
Figure 4E:
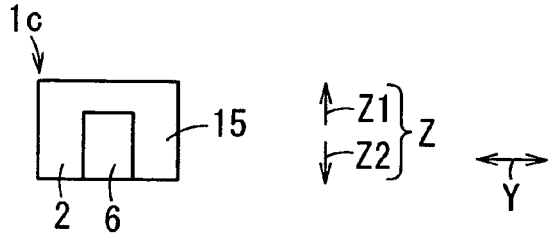
Figure 4F:
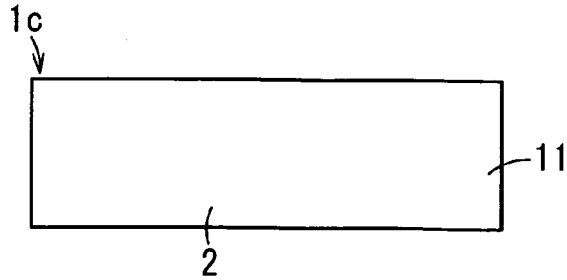

FIGS. 4A to 4F are six-side views showing the structure of the third surface-mount type antenna 1*c*. FIG. 4A is a front view of the third surface-mount type antenna 1*c*; FIG. 4B is a plan view thereof; FIG. 4C is a rear view thereof; FIG. 4D is a right-hand side view thereof; FIG. 4E is a left-hand side view thereof; and FIG. 4F is a bottom view thereof.

In the third surface-mount type antenna 3*c*, the ground electrode 3 is so formed as to extend continuously over the second, sixth, and fourth surfaces 12, 16, and 14. That part of the ground electrode 3 which lies on the second surface 12, namely, the ground electrode portion 3*a*, has a quadrilateral shape. When viewed in the longitudinal direction X, the ground electrode portion 3*a* is arranged on the longitudinal direction X1-wise side of the second surface 12 relative to the midsection thereof. The ground electrode portion 3*a* extends from one end to the other end of the second surface 12 in the thicknesswise direction Z. The longitudinal direction X-wise dimension of the ground electrode portion 3*a* formed on the second surface 12 is determined in such a way as described previously.

When viewed in the longitudinal direction X, that part of the ground electrode 3 which lies on the second surface 12, namely, the ground electrode portion 3*a*, is arranged at a position between the free ends 21 and 22 of the first and second radiating electrodes 4 and 5 formed on the sixth surface 16.

The ground electrode 3 extends continuously from the second surface 12 to the sixth surface 16, and then extends from one transverse direction Y-wise end 53 toward the other transverse direction Y-wise end 54 on the sixth surface 16. Further, the ground electrode 3 extends continuously from the sixth surface 16 to the fourth surface 14, and then extends from one end to some midpoint of the fourth surface 14 in the thicknesswise direction Z; that is, extends from one thicknesswise direction Z1 toward the other thicknesswise direction Z2. The ground electrode portions formed on the fourth and sixth surfaces 14 and 16 each have a quadrilateral shape. The ground electrode portions formed on the fourth and sixth surfaces 14 and 16 are equal to the ground electrode portion 3*a* formed on the second surface 12 in terms of the longitudinal direction X-wise dimension.

The first and second radiating electrodes 4 and 5 are continuous with the thicknesswise direction Z2-wise end of the ground electrode 3 portion formed on the fourth surface 14. On the fourth surface 14, the first radiating electrode 4 extends from the thicknesswise direction Z2-wise end of the ground electrode 3 in one longitudinal direction X1 and then turns at one longitudinal direction X-wise end of the fourth surface 14 so as to extend further in the thicknesswise direction Z1 toward the sixth surface 16. That part of the first radiating electrode 4 which lies on the sixth surface 16 extends from the other transverse direction Y-wise end 54 toward one transverse direction Y-wise end 53 on the sixth surface 16, and then turns at one transverse direction Y-wise end 53 so as to extend further in the other longitudinal direction X2. A predetermined spacing W2 is secured between the free end 21 of the first radiating electrode 4 and that part of the ground electrode 3 which lies on the sixth surface 16.

On the fourth surface 14, the second radiating electrode 5 extends from the thicknesswise direction Z2-wise end of the ground electrode 3 in the other longitudinal direction X2 and then turns at the other longitudinal direction X-wise end of the fourth surface 14 so as to extend further in the thicknesswise direction Z1 toward the sixth surface 16. That part of the second radiating electrode 5 which lies on the sixth surface 16 extends from the other transverse direction Y-wise end 54 toward one transverse direction Y-wise end 53 on the sixth surface 16, and then turns at one transverse direction Y-wise end 53 so as to extend further in one longitudinal direction X1. A predetermined spacing W2 is secured between the free end 22 of the second radiating electrode 5 and that part of the ground electrode 3 which lies on the sixth surface 16.

The extending direction-wise lengths of the first and second radiating electrodes 4 and 5 are determined on the basis of a frequency corresponding to transmission or reception. The extending direction-wise length of the first radiating electrode 4 is made shorter than that of the second radiating electrode 5. In this way, the first radiating electrode 4 constitutes a quarter-wavelength monopole antenna which is adaptable to, of radio signals in a range of frequencies for use in a multiple frequency-adaptable communication apparatus, the one of higher frequency f1, whereas the second radiating electrode 5 constitutes another quarter-wavelength monopole antenna which is adaptable to radio signals of lower frequency f2 for use in the same communication apparatus.

The free ends 21 and 22 of the first and second radiating electrodes 4 and 5 are arranged face to face with each other in the longitudinal direction X, with the ground electrode 3 lying therebetween. In each of the first and second radiating electrodes 4 and 5, the radiating electrode portion formed on the fourth surface 14 and that formed on the sixth surface 16 are made equal in width in such a way as described previously.

The first and second feeding electrodes 6 and 7 are formed on the two surfaces of the base body 2 that confront each other in the longitudinal direction X, namely, the third and fifth surfaces 13 and 15, respectively. That is, on the third surface 13 is formed the second feeding electrode 7, and on the fifth surface 15 is formed the first feeding electrode 6.

The first feeding electrode 6 is formed in the midsection of the fifth surface 15 as viewed in the transverse direction Y. When viewed in the thicknesswise direction Z, the first feeding electrode 6 extends from one end to some midpoint of the fifth surface 15. The second feeding electrode 7 is formed in the midsection of the third surface 13 as viewed in the transverse direction Y. When viewed in the thicknesswise direction Z, the second feeding electrode 7 extends from one end to some midpoint of the third surface 13. The first and second feeding electrodes 6 and 7 confront each other in the longitudinal direction X.

In the third surface-mount type antenna 1*c*, the first surface 11 is free from any of the ground electrode 3, the first and second radiating electrodes 4 and 5, and the first and second feeding electrodes 6 and 7.

Figure 5A:
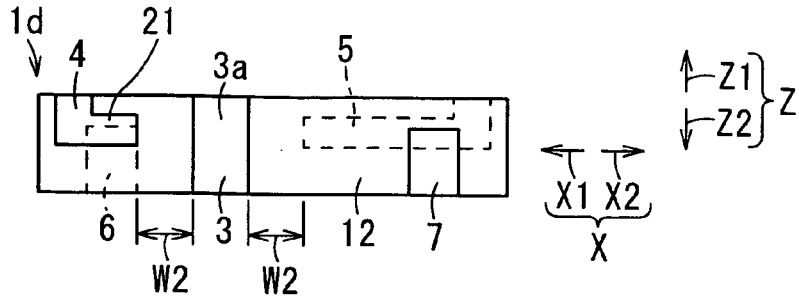
FIGS. 5A through 5F are six-side views showing a structure of a surface-mount type antenna according to a fourth embodiment of the invention.
Figure 5B:
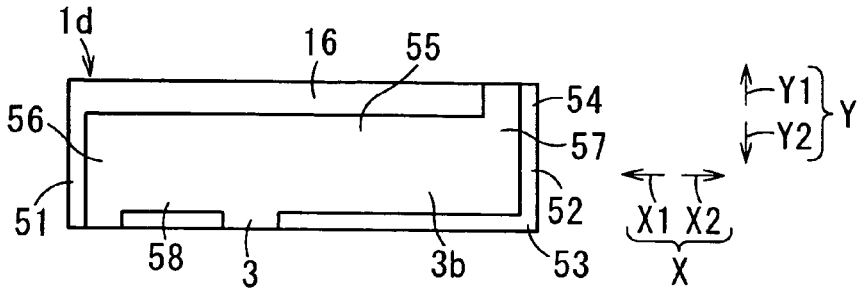
Figure 5C:
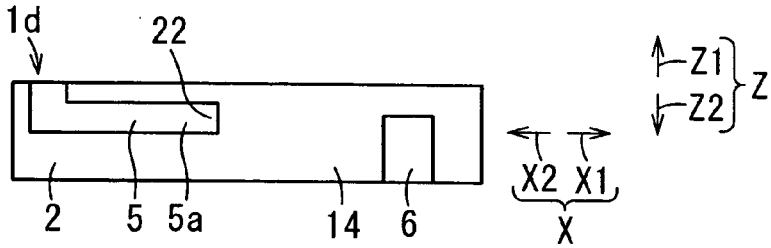
Figure 5D:
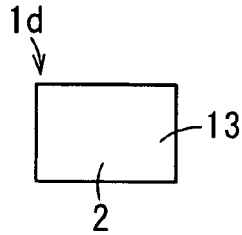
Figure 5E:
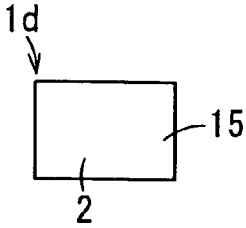
Figure 5F:
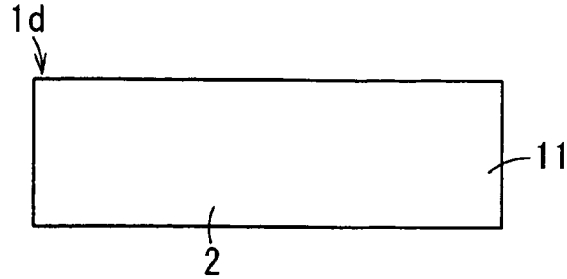

FIGS. 5A to 5F are six-side views showing the structure of the fourth surface-mount type antenna 1*d*. FIG. 5A is a front view of the fourth surface-mount type antenna 1*d*; FIG. 5B is a plan view thereof; FIG. 5C is a rear view thereof; FIG. 5D is a right-hand side view thereof; FIG. 5E is a left-hand side view thereof; and FIG. 5F is a bottom view thereof.

In the fourth surface-mount type antenna 1*d*, the ground electrode 3 has basically the same structure as that of the second surface-mount type antenna 1*b*, and therefore the explanation therefor will be omitted.

In that part of the ground electrode 3 which lies on the sixth surface 16, namely, the ground electrode portion 3*b*, at one transverse direction Y-wise end 58 of the ground electrode portion 3*b*, one longitudinal direction X-wise end 56 is continuous with the first radiating electrode 4, and, at the other transverse direction Y-wise end 55, the other longitudinal direction X-wise end 57 is continuous with the second radiating electrode 5. The first radiating electrode 4, which is continuous with the ground electrode 3, extends in the other transverse direction Y2 toward the second surface 12. That part of the first radiating electrode 4 which lies on the second surface 12 extends from one thicknesswise direction Z1 to the other thicknesswise direction Z2, and then turns at some midpoint of the second surface 12 as viewed in the thicknesswise direction Z so as to extend further in the other longitudinal direction X2. A predetermined spacing W2 is secured between the free end 21 of the first radiating electrode 4 and the ground electrode portion 3*a* formed on the second surface 12.

The second radiating electrode 5, which is continuous with the ground electrode 3, extends in one transverse direction Y1 toward the fourth surface 14. That part of the second radiating electrode 5 which lies on the fourth surface 14, namely, the second radiating electrode portion 5*a*, extends from one thicknesswise direction Z1 to the other thicknesswise direction Z2, and then turns at some midpoint of the fourth surface 14 as viewed in the thicknesswise direction Z so as to extend further in one longitudinal direction X1. When viewed in the longitudinal direction X, a predetermined spacing W2 is secured between the free end 22 of the second radiating electrode 5 and the ground electrode portion 3*a* formed on the second surface 12.

Moreover, the first radiating electrode 4 portion formed on the second surface 12, specifically, the free end 21, as well as the second radiating electrode 5 portion formed on the fourth surface 14, specifically, the free end 22, are arranged, when viewed in the thicknesswise direction Z, on the thicknesswise direction Z1-wise sides of the second and fourth surfaces 12 and 14 relative to the midsections thereof, respectively. By virtue of such an arrangement, at the time of mounting the surface-mount type antenna 1*d* on a mounting substrate with the first surface 11 facing with the mounting substrate, it never occurs that the first and second radiating electrodes 4 and 5 are adversely affected by unwanted radiation from the mounting substrate due to too small a spacing between the mounting substrate and the first and second radiating electrodes 4 and 5.

The extending direction-wise lengths of the first and second radiating electrodes 4 and 5 are determined on the basis of a frequency corresponding to transmission or reception. The extending direction-wise length of the first radiating electrode 4 is made shorter than that of the second radiating electrode 5. In this way, the first radiating electrode 4 constitutes a quarter-wavelength monopole antenna which is adaptable to, of radio signals in a range of frequencies for use in a multiple frequency-adaptable communication apparatus, the one of higher frequency f1, whereas the second radiating electrode 5 constitutes another quarter-wavelength monopole antenna which is adaptable to radio signals of lower frequency f2 for use in the same communication apparatus. The first and second radiating electrodes 4 and 5 are made equal in width in such a way as described previously.

The first and second feeding electrodes 6 and 7 are formed on, of the second to fifth surfaces 12, 13, 14, and 15, two parallelly-arranged surfaces, respectively, in such a manner as not to confront each other. More specifically, the first feeding electrode 6 is formed on the fourth surface 14, whereas the second feeding electrode 7 is formed on the second surface 12 located in parallel with the fourth surface 14. At the longitudinal direction X1-wise end of the fourth surface 14, the first feeding electrode 6 extends from one end to some midpoint of the fourth surface 14 in the thicknesswise direction Z1. Moreover, at the longitudinal direction X2-wise end of the second surface 12, the second feeding electrode 7 extends from the other end to some midpoint of the second surface 12 in the thicknesswise direction Z. The first and second feeding electrodes 6 and 7 each have substantially a quadrilateral shape. In addition, the first and second feeding electrodes 6 and 7 are arranged in such a manner as not to confront each other in the transverse direction Y.

As shown in FIG. 5A, when viewed in the transverse direction Y, the first feeding electrode 6 has its one part opposed to the first radiating electrode 4 formed on the second surface 12, and likewise the second feeding electrode 7 has its one part opposed to the second radiating electrode 5 formed on the fourth surface 14.

In the fourth surface-mount type antenna 1*d*, the first, third, and fifth surfaces 11, 13, and 15 are free from any of the ground electrode 3, the first and second radiating electrodes 4 and 5, and the first and second feeding electrodes 6 and 7.

Figure 6A:
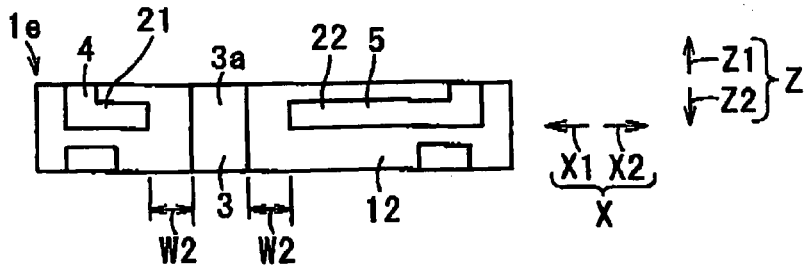
FIGS. 6A through 6F are six-side views showing a structure of a surface-mount type antenna according to a fifth embodiment of the invention.
Figure 6B:
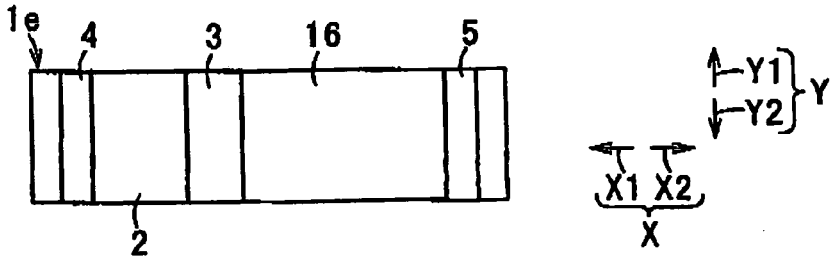
Figure 6C:
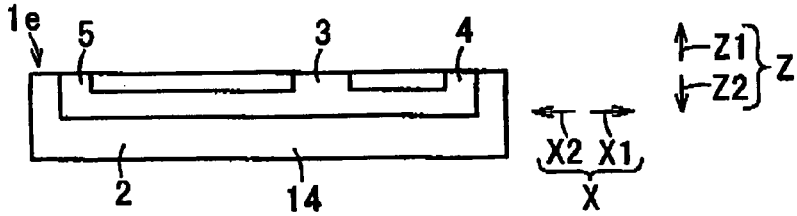
Figure 6D:
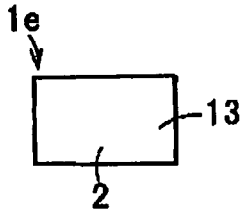
Figure 6E:
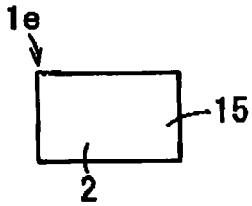
Figure 6F:
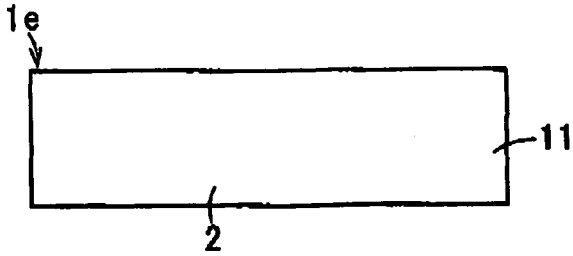

FIGS. 6A to 6F are six-side views showing the structure of the fifth surface-mount type antenna 1*e*. FIG. 6A is a front view of the fifth surface-mount type antenna 1*e*; FIG. 6B is a plan view thereof; FIG. 6C is a rear view thereof; FIG. 6D is a right-hand side view thereof; FIG. 6E is a left-hand side view thereof; and FIG. 6F is a bottom view thereof.

In the fifth surface-mount type antenna 1*e*, the ground electrode 3 has basically the same structure as that of the third surface-mount type antenna 1*c*, and therefore the explanation therefor will be omitted.

The first and second radiating electrodes 4 and 5 are continuous with the thicknesswise direction Z2-wise end of the ground electrode 3 portion formed on the fourth surface 14. The first and second radiating electrodes 4 and 5 are each so formed as to extend continuously over the second, sixth, and fourth surfaces 12, 16, and 14. On the fourth surface 14, the first radiating electrode 4 extends from the thicknesswise direction Z2-wise end of the ground electrode 3 in one longitudinal direction X1 and then turns at one longitudinal direction X-wise end of the fourth surface 14 so as to extend further in the thicknesswise direction Z1 toward the sixth surface 16. That part of the first radiating electrode 4 which lies on the sixth surface 16 extends from the other transverse direction Y-wise end toward one transverse direction Y-wise end on the sixth surface 16. Then, the first radiating electrode 4 extends continuously from the sixth surface 16 to the second surface 12, then extends further, on the second surface 12, from one thicknesswise direction Z1 to the other thicknesswise direction Z2, and then turns at some midpoint of the second surface 12 as viewed in the thicknesswise direction Z so as to extend further in the other longitudinal direction X2. A predetermined spacing W2 is secured between the free end 21 of the first radiating electrode 4 and the ground electrode 3 portion formed on the sixth surface 16.

On the fourth surface 14, the second radiating electrode 5 extends from the thicknesswise direction Z2-wise end of the ground electrode 3 in the other longitudinal direction X2 and then turns at the other longitudinal direction X-wise end of the fourth surface 14 so as to extend further in the thicknesswise direction Z1 toward the sixth surface 16. That part of the second radiating electrode 5 which lies on the sixth surface 16 extends from the other transverse direction Y-wise end toward one transverse direction Y-wise end on the sixth surface 16. Then, the second radiating electrode 5 extends continuously from the sixth surface 16 to the second surface 12, then extends further from one end to the other end on the second surface 12 in the thicknesswise direction Z, and then turns at some midpoint of the second surface 12 as viewed in the thicknesswise direction Z so as to extend further in one longitudinal direction X1. A predetermined spacing W2 is secured between the free end 22 of the second radiating electrode 5 and the ground electrode 3 portion formed on the second surface 12.

The free ends 21 and 22 of the first and second radiating electrodes 4 and 5 are arranged face to face with each other, with the ground electrode 3 lying therebetween. In each of the first and second radiating electrodes 4 and 5, the radiating electrode portion formed on the fourth surface 14 and that formed on the sixth surface 16 are made equal in width in such a way as described previously.

Moreover, the first radiating electrode 4 portion formed on the second surface 12, specifically, the free end 21, as well as the second radiating electrode 5 portion formed on the second surface 12, specifically, the free end 22, are arranged, when viewed in the thicknesswise direction Z, on the thicknesswise direction Z1-wise side of the second surface 12 relative to the midsection thereof. By virtue of such an arrangement, at the time of mounting the surface-mount type antenna 1*e* on a mounting substrate with the first surface 11 facing with the mounting substrate, it never occurs that the first and second radiating electrodes 4 and 5 are adversely affected by unwanted radiation from the mounting substrate due to too small a spacing between the mounting substrate and the first and second radiating electrodes 4 and 5.

The first and second feeding electrodes 6 and 7 are formed on the second surface 12 having the ground electrode 3. On the second surface 12, the first and second feeding electrodes 6 and 7 are spaced apart to provide the ground electrode 3 in between. The first and second feeding electrodes 6 and 7 are arranged substantially at both ends of the second surface 12 as viewed in opposite directions away from the ground electrode 3; that is, arranged substantially at both longitudinal direction X-wise ends of the second surface 12. More specifically, the first feeding electrode 6 is arranged at the longitudinal direction X1-wise end of the second surface 12, whereas the second feeding electrode 7 is arranged at the longitudinal direction X2-wise end of the second surface 12. The first and second feeding electrodes 6 and 7 are so formed as to extend from the other end to some midpoint of the second surface 12 in the thicknesswise direction Z. The first and second feeding electrodes 6 and 7 each have substantially a quadrilateral shape.

On the second surface 12, the first feeding electrode 6 and the first radiating electrode 4 are arranged at a predetermined spacing, and likewise the second feeding electrode 7 and the second radiating electrode 5 are arranged at a predetermined spacing.

In the first surface-mount type antenna 1*a*, the first, third, and fifth surfaces 11, 13, and 15 are free from any of the ground electrode 3, the first and second radiating electrodes 4 and 5, and the first and second feeding electrodes 6 and 7.

In each of the surface-mount type antenna 1, the first and second radiating electrodes 4 and 5 have base ends which are one end thereof, connected to a common ground electrode 3, whereby making it possible to reduce the size of the surface-mount type antenna 1 as a whole. In other words, by configuring the first and second radiating electrodes 4 and 5 in such a way as to be connected to a single, common ground electrode 3, in contrast to the case of providing the ground electrode 3 separately for the individual first and second radiating electrodes 4 and 5, it is possible to reduce the surface area of base body 2 necessary to form the first and second radiating electrodes 4 and 5 and the common ground electrode 3. As a consequence, the base body 2 can be made compact, which leads to down-sizing of the apparatus as a whole.

Moreover, in each of the surface-mount type antenna 1, the first and second radiating electrodes 4 and 5 are so configured as to extend over two or more surfaces of the base body 2 that are adjacent to each other; that is, they are three-dimensionally configured. This helps increase the cubic volume of that part of the antenna which is responsible for radiation and reception. In light of the fact that antenna characteristics are proportional to the size of an antenna, such a configuration is desirable in terms of enhancement of antenna characteristics such that transmission efficiency and reception efficiency can be enhanced, and gain can be enhanced, and frequency bandwidth can be widened due to the increasing cubic volume of that part of the antenna which is responsible for radiation and reception.

In such first to fifth surface-mount type antennas 1*a* through 1*e* according to the invention, a ¼ wavelength monopole antenna adaptable to a higher frequency f1 of radio signals of frequency bands used in a multiple frequency-adaptable communication system is formed by a part of the first radiating electrode 4. In addition, a ¼ wavelength monopole antenna adaptable to a lower frequency f2 of radio signals of frequency bands used in the same communication system is formed by a part of the second radiating electrode 5. Therefore, the first to fifth surface-mount type antennas 1*a* through 1*e* can operate as surface-mount type antennas 1*a* through 1*e* adaptable to a plurality of the frequencies f1 and f2.

Referring to FIG. 1A, in the first surface-mount type antenna 1*a*, the first and second feeding electrodes 6 and 7 are formed on a second surface 12 of the base body 2, with the ground electrode 3 lying therebetween, that is to say, the first and second feeding electrodes 6 and 7 are spaced apart to provide the ground electrode 3 in between. In this example, by arranging the feeding electrodes 6 and 7 in such a manner as not to confront each other in a surface-wise manner, with the ground electrode 3 interposed therebetween, it is possible to eliminate the occurrence of direct interference between the first and second feeding electrodes 6 and 7. As a result, mutual interference can be minimized between the two feeding electrodes 6 and 7.

In the case of forming the first and second feeding electrodes 6 and 7 on one surface of the base body 2 in that way, the first and second feeding electrodes 6 and 7 need to be spaced apart to provide the ground electrode 3 in between.

Particularly, when the first and second feeding electrodes 6 and 7 are arranged substantially at both ends of one surface of the base body 2 in opposite directions away from the ground electrode 3, it is possible to secure as large a spacing as possible between the two feeding electrodes 6 and 7, and thereby reduce mutual interference to a minimum between the first and second feeding electrodes 6 and 7 of those formed on the one surface of the base body 2.

Referring to FIG. 1B, in the second surface-mount type antenna 1*b*, the first and second feeding electrodes 6 and 7 are formed on different surfaces of the base body 2 that are adjacent to each other, with the ground electrode 3 lying therebetween. In this case, by arranging the first and second feeding electrodes 6 and 7 in such a manner as not to confront each other in a surface-wise manner, with the ground electrode 3 interposed in a direction of continuing the second to fifth surfaces 12, 13, 14, and 15 between the first and second feeding electrodes 6 and 7, it is possible to eliminate the occurrence of direct interference between the first and second feeding electrodes 6 and 7. As a result, mutual interference can be minimized between the two feeding electrodes 6 and 7.

Also in the case of forming the first and second feeding electrodes 6 and 7 on different yet adjoining surfaces of the base body 2, the ground electrode 3 needs to be disposed between the first and second feeding electrodes 6 and 7.

Particularly, in a case where the first and second feeding electrodes 6 and 7 are formed on the two adjoining surfaces of the base body 2, and the feeding electrode 6 is formed at one end of its corresponding surface, the end being non-adjacent to the surface to which the feeding electrode 7 belongs, and similarly the feeding electrode 7 is formed at one end of its corresponding surface, the end being non-adjacent to the surface to which the feeding electrode 6 belongs, it is possible to secure as large a spacing as possible between the two feeding electrodes 6 and 7, and thereby reduce mutual interference to a minimum between the feeding electrodes 6 and 7 of those formed on the two surfaces that are adjacent to each other.

Referring to FIG. 1C, in the third surface-mount type antenna 1*c*, the feeding electrodes 6 and 7 are formed on different surfaces of the base body 2 that confront each other in a direction longitudinally of the base body 2. In this case, although the first and second feeding electrodes 6 and 7 confront each other in a surface-wise manner, because of the arrangement along the longitudinal direction of the base body 2, it is possible to secure a sufficient spacing between the opposed first and second feeding electrodes 6 and 7. As a result, mutual interference can be minimized between the two feeding electrodes 6 and 7.

In the case of forming the first and second feeding electrodes 6 and 7 on different surfaces of the base body 2 that confront each other in the longitudinal direction of the base body 2, each of the first and second feeding electrodes 6 and 7 may basically be formed at any given position on its corresponding surface. Thereby, it is possible to increase the placement flexibility for the first and second feeding electrodes 6 and 7. In a case where the first and second feeding electrodes 6 and 7 are formed on the two surfaces that confront each other in the longitudinal direction of the base body 2, preferably, the first and second feeding electrodes 6 and 7 are so formed as to be staggered with respect to each other to avoid direct confrontation. Thereby, it is possible to suppress mutual interference between the two feeding electrodes 6 and 7.

Referring to FIG. 1D, in the first surface-mount type antenna 1*d*, the first and second feeding electrodes 6 and 7 are formed on different surfaces of the base body 2, the surfaces being perpendicular to a transverse direction Y, in such a manner as not to confront each other. In this case, the two feeding electrodes 6 and 7 are arranged facingly at an angle with each other; wherefore mutual interference can be minimized between the feeding electrodes 6 and 7.

In the case of forming the first and second feeding electrodes 6 and 7 on different surfaces of the base body 2, the surfaces being perpendicular to the transverse direction Y, in such a manner as not to confront each other, by forming the first feeding electrode 6 at one end of one direction X1 in the longitudinal direction X and forming the second feeding electrode at one end of the other direction X2 in the longitudinal direction X, it is preferable to secure as large an angle as possible with respect to the transverse direction Y between the opposed feeding electrodes 6 and 7.

Moreover, in both the first and second surface-mount type antennas 1*a* and 1*b* shown in FIGS. 1A and 1B the radiating electrodes 4 and 5 have free ends 21 and 22 thereof, which are open ends, opposed to each other. In a sense, the first and second radiating electrodes 4 and 5 can be regarded as each other's parts. That is, one radiating electrode 4 (or 5) can be regarded as being connected with the other radiating electrode 5 (or 4), with a gap lying between the free ends 21 and 22 of the first and second radiating electrodes 4 and 5, to constitute a single radiating electrode. From such a perception, the first and second radiating electrode 4 and 5 are allowed to have longer electrical lengths in practice. Thus, at the time of length adjustment required to obtain a desired frequency, the first and second radiating electrodes 4 and 5 can be made shorter in contrast to a time that the first and second radiating electrodes 4 and 5 do not have the free ends 21 and 22 opposed each other. This helps reduce the size of the antenna as a whole.

In the case of forming the first and second radiating electrodes 4 and 5 in such a way that the free ends 21 and 22 thereof which are open ends are opposed to each other, an spacing W1 predetermined between the free ends 21 and 22 of the first and second radiating electrodes 4 and 5 should preferably be selected within a range of 0.1 mm to 5 mm. If the predetermined spacing W1 is less than 0.1 mm, in case of accidental adhesion of foreign matters such as solder, during the course of the manufacture of wireless communication apparatuses, there is a risk of causing electrical shortings to the first and second radiating electrodes 4 and 5, which will eventually cause the antenna to malfunction. By way of contrast, if the predetermined spacing W1 is greater than 5 mm, it becomes difficult to attain an effect that one radiating electrode is regarded as the other electrode's part. It is thus preferable that the predetermined spacing W1 is set to fall in a range from 0.1 to 5 mm. By doing so, not only it is possible to prevent electrical shortings from occurring in the first and second radiating electrodes 4 and 5, but it is also possible to actualize, more positively, the perception that the two radiating electrodes 4 and 5 can be regarded as each other's parts.

Referring to FIGS. 1C and 1E, in the third through fifth surface-mount type antennas 1*c* and 1*e*, the first and second radiating electrodes 4 and 5 have the free ends 21 and 22 thereof which are open ends opposed to each other, with the ground electrode 3 lying therebetween. In this case, by interposing the ground electrode 3 which differs in phase from the first and second radiating electrodes 4 and 5, it is possible to avoid direct confrontation of the open ends of the first and second radiating electrodes 4 and 5 of equal phase that leads to the occurrence of significant mutual interference, and thereby minimize mutual interference between the two radiating electrodes 4 and 5. Therefore, even if the first and second radiating electrodes 4 and 5 are inevitably placed in the proximity of each other in accompaniment with miniaturization of the base body 2, it is possible to suppress mutual interference between the first and second radiating electrodes 4 and 5, and thereby avoid deterioration of antenna characteristics that is ascribable to miniaturization of the apparatus as a whole. In addition, frequency adjustment can be made with respect to two different frequencies separately at the open ends of the first and second radiating electrodes 4 and 5.

In the case of forming the first and second radiating electrodes 4 and 5 in such a way that the free ends 21 and 22 thereof which are open ends, are opposed to each other, the free ends 21 and 22 need to be spaced apart to provide the ground electrode 3 in between. Moreover, the predetermined spacing W2 secured between the free end 21, 22 of the first, second radiating electrode 4, 5 and the ground electrode 3 should preferably be set at 0.1 mm or above. This is because, if the spacing W2 is unduly small, in case of accidental adhesion of foreign matters such as solder during the course of the manufacture of wireless communication apparatuses, there is a risk of bringing about electrical shortings between the first, second radiating electrode 4, 5 and the ground electrode 3 that will eventually cause the antenna to malfunction. For this reason, it is desirable to secure as long a distance as possible between the free end of the radiating electrode and the ground electrode reasonably in consideration of the size of the base body 2.

In the fourth surface-mount type antenna 1*d* shown in FIG. 1D, of the free ends 21 and 22 which are the open ends of the first and second radiating electrodes 4 and 5, one is formed on one surface, and the other is formed on the other surface of a pair of parallel surfaces of the base body 2. In this way, a sufficient spacing can be secured between the free ends 21 and 22 of the first and second radiating electrodes 4 and 5; wherefore mutual interference can be minimized between the two radiating electrodes 4 and 5.

In the case of forming one of free ends 21 and 22 which are the open ends of the first and second radiating electrodes 4 and 5 on one surface, and forming the other one on the other surface of a pair of the parallel surfaces of the base body 2, it is desirable to secure as long a distance as possible between the free ends 21 and 22 of the radiating electrodes 4 and 5.

Figure 7A:
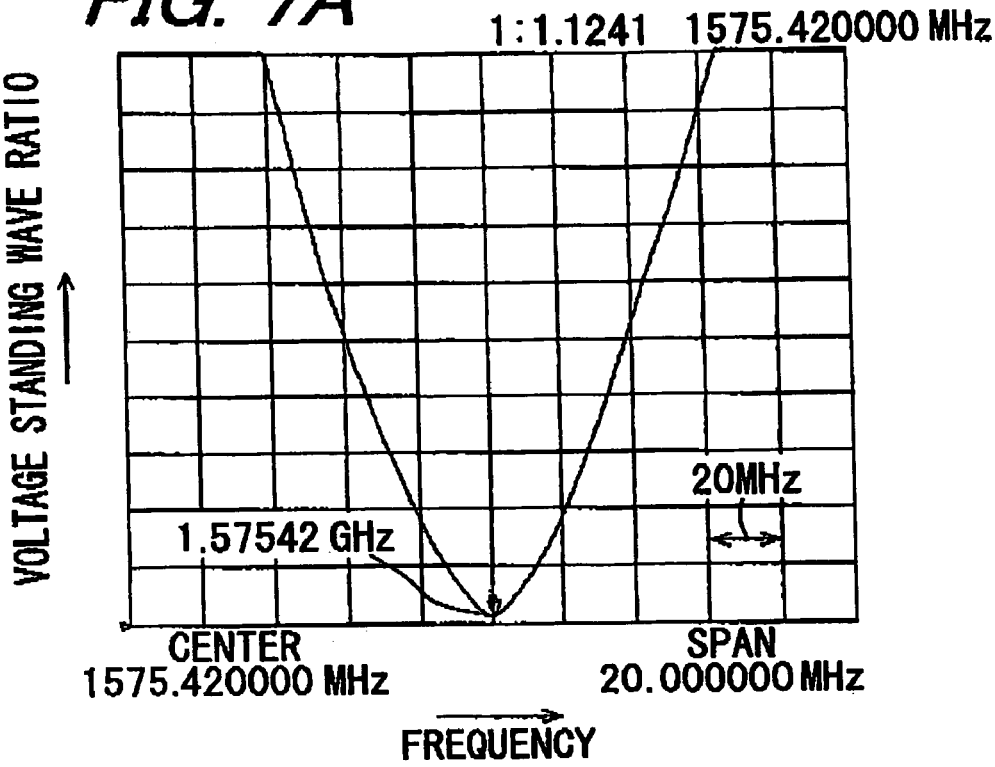
FIGS. 7A and 7B are diagrams showing examples of frequency characteristics on reflection loss of the surface-mount type antenna embodying the invention.
Figure 7B:
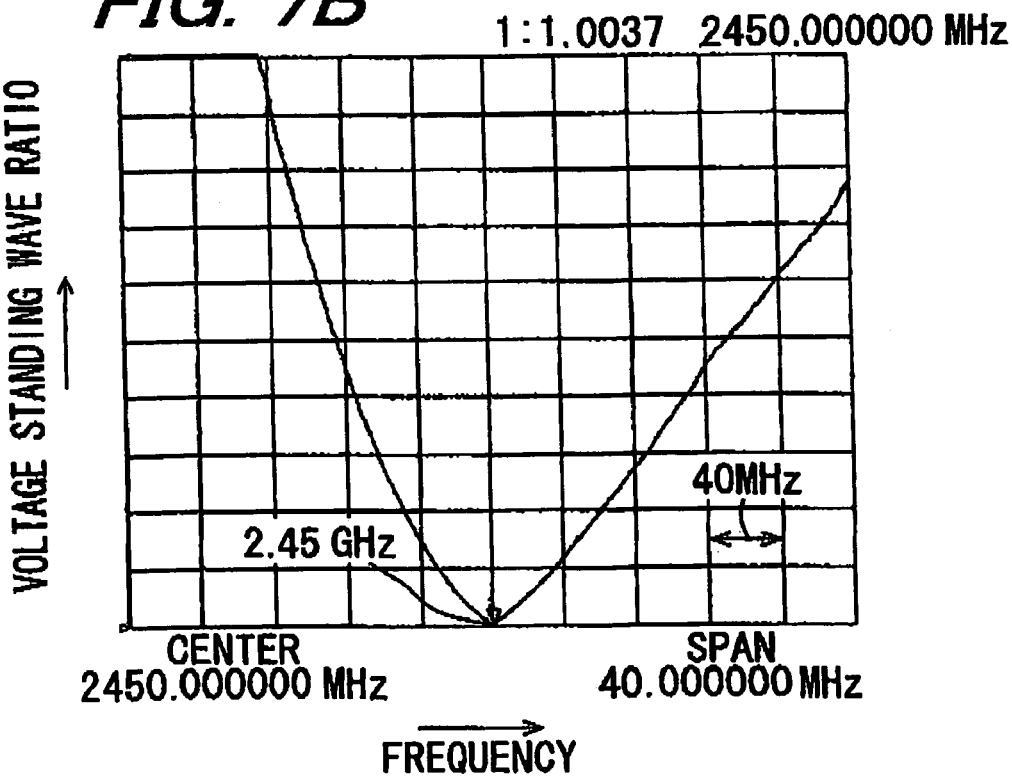

Next, the charts depicted in FIGS. 7A and 7B show the frequency characteristics on reflection loss of the respective surface-mount type antenna 1 embodying the invention. In FIGS. 7A and 7B, frequency is taken along the horizontal axis and VSWR (Voltage Standing Wave Ratio) is taken along the vertical axis. The characteristic curves indicate VSWR frequency characteristics. Moreover, FIG. 7A is related to a lower frequency f2 (GPS, as exemplified), whereas FIG. 7B is related to a higher frequency f1 (Bluetooth, as exemplified). As will be understood from these charts, the surface-mount type antenna 1 of the invention functions as a multiple frequency-adaptable antenna designed for use at two different frequencies f1 and f2. In FIG. 7A, VSWR reaches the lowest value at a frequency of 1.57542 GHz. In FIG. 7B, VSWR reaches the lowest value at a frequency of 2.45 GHz.

As described heretofore, according to the surface-mount type antenna 1 of the respective embodiment of the invention, the first and second radiating electrodes 4 and 5 corresponding to the two different frequencies f1 and f2 are arranged in such a positional relationship as described hereinabove. This helps facilitate adjustment of the antenna characteristics such as resonant frequency, and impedance matching, associated with the frequencies f1 and f2, respectively. The reason will be described hereinbelow.

For example, in order to adjust the higher frequency f1 to a high level, the free end 21 of the first radiating electrode 4 corresponding to the higher frequency f1 is subjected to trimming step by step so that the extending direction-wise length of the first radiating electrode 4 is reduced. In this way, the electrical length is decreased in terms of resonance, thus achieving high-frequency adjustment. On the other hand, in order to adjust the higher frequency f1 to a low level, the free end 21 of the first radiating electrode 4 is elongated; that is, an extra electrode portion is added to the free end 21 of the first radiating electrode 4. In this way, the electrical length is increased in terms of resonance, thus achieving low-frequency adjustment.

Likewise, in order to adjust the lower frequency f2 to a high level, the free end 22 of the second radiating electrode 5 corresponding to the lower frequency f2 is subjected to trimming step by step so that the extending direction-wise length of the second radiating electrode 5 is reduced. In this way, the electrical length is decreased in terms of resonance, thus achieving high-frequency adjustment. On the other hand, in order to adjust the lower frequency f2 to a low level, the free end 22 of the second radiating electrode 5 is elongated; that is, an extra electrode portion is added to the free end 22 of the second radiating electrode 5. In this way, the electrical length is increased in terms of resonance, thus achieving low-frequency adjustment.

As described previously, the first and second radiating electrodes 4 and 5 have their one ends connected to the common ground electrode 3, yet their free ends 21 and 22 formed into an open end, respectively. This helps facilitate such trimming operation and addition of an electrode portion as described above, and thereby facilitate adjustment of the transmission or reception frequency.

Moreover, as for the lower frequency f2, adjustment of impedance matching is effected by controlling the degree of capacitance coupling of the second feeding electrode 7 with respect to the second radiating electrode 5. Specifically, for example, the front end of the second feeding electrode 7 corresponding to the second radiating electrode 5, namely, the thicknesswise direction Z1-wise end of the second feeding electrode 7 is subjected to trimming step by step or is added with an extra electrode portion. In this way, the impedance-matching adjustment can be achieved with ease. Since the second feeding electrode 7 is capacitance-coupled to its corresponding second radiating electrode 5, the impedance-matching adjustment can be achieved by changing the configuration and area of the second feeding electrode 7 as described above. As another method therefor, it is effective to connect an LC circuit composed of an reactor L and a capacitor C to the second feeding electrode 7. In this case, by controlling matching circuit constants, the impedance-matching adjustment can be achieved with ease. By similar methods, as for the higher frequency f1, adjustment of impedance matching is effected by controlling the degree of capacitance coupling of the first feeding electrode 6 with respect to the first radiating electrode 4.

Figure 8A:
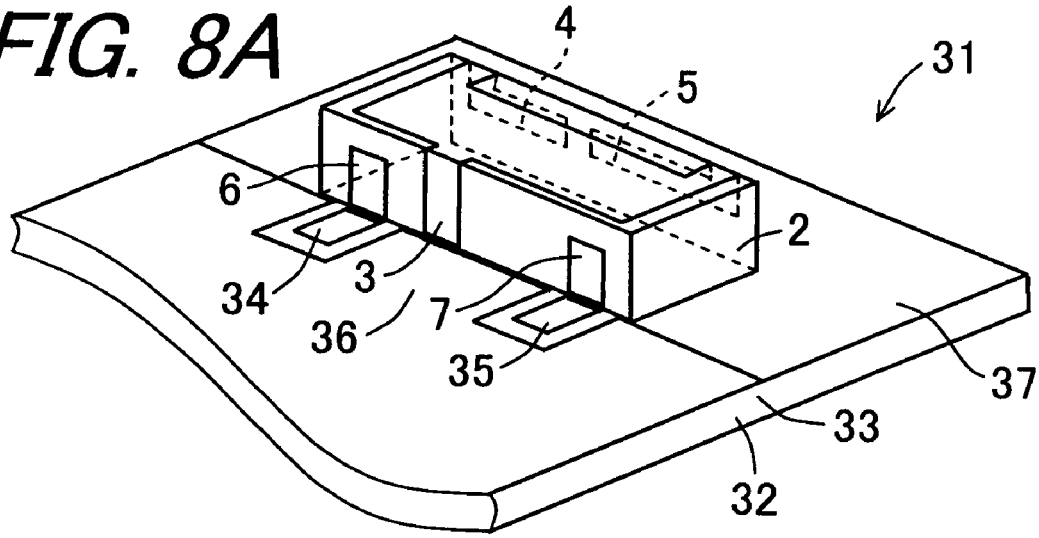
FIGS. 8A and 8B are perspective views each showing an example in an embodiment of an antenna apparatus of the invention employing the surface-mount type antenna of the invention.
Figure 8B:
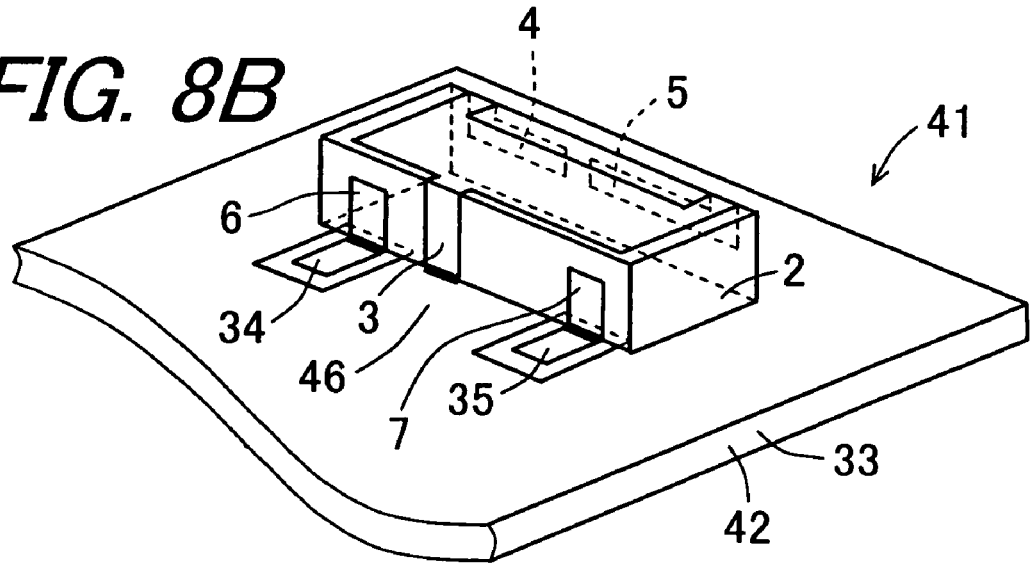

Next, a description will be given below as to the antenna apparatuses 31 and 41 of the respective embodiment according to the invention, with reference to FIGS. 8A and 8B each showing a perspective view. Hereinafter, there may be cases where the antenna apparatus 31 implemented as the first embodiment of the invention will be referred to as "the first antenna apparatus 31", and the antenna apparatus 41 implemented as the second embodiment of the invention will be referred to as "the second antenna apparatus 41". In FIGS. 8A and 8B, the constituent components that play the same or corresponding roles as in FIG. 1 are identified with the same reference symbols; that is, reference numeral 2 denotes a base body; 3 denotes a ground electrode; 4 and 5 denote a first radiating electrode and a second radiating electrode, respectively; and 6 and 7 denote a first feeding electrode and a second feeding electrode, respectively. Moreover, reference numerals 31 and 41 denote an antenna apparatus; 32 and 42 denote a mounting substrate; 34 and 35 denote a first feeding terminal and a second feeding terminal, respectively, that are formed on the mounting substrate 32, 42; and 36 and 46 denote a ground conductor layer.

The antenna apparatus 31, 41 of the invention is constructed by mounting the surface-mount type antenna 1*a* of the invention on the mounting substrate 32, 42, with the first and second feeding electrodes 6 and 7 connected to the first and second feeding terminals 34 and 35, respectively, and with the ground electrode 3 connected to the ground conductor layer 36, 46.

Figure 9A:
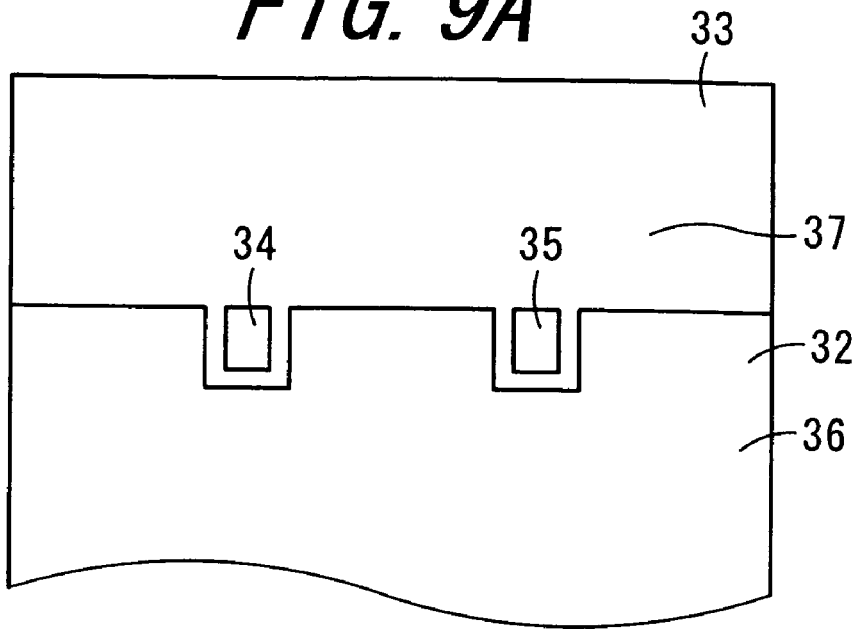
FIGS. 9A and 9B are plan views showing a mounting substrate in the antenna apparatus.

FIG. 9A is a plan view showing the mounting substrate 32 for constituting the first antenna apparatus 31. The mounting substrate 32 is composed of a tabular base plate 33; the first and second feeding terminals 34 and 35 formed on one surface of the base plate 33 as viewed in the thicknesswise direction; and the ground conductor layer 36 formed on the same surface. The first and second feeding terminals 34 and 35 are arranged in correspondence with the positions of the first and second feeding electrodes 6 and 7 of the surface-mount type antenna 1*a*, respectively. In this way, at the time of mounting the surface-mount type antenna 1 on the mounting substrate 32 with the first surface 11 facing with the mounting substrate 32, the first and second feeding terminals 34 and 35 can readily be connected with the first and second feeding electrodes 6 and 7, respectively, by means of solder.

The ground conductor layer 36 is arranged on one side of the surface of the base plate 33 opposite to the other side thereof on which the surface-mount type antenna 1*a* is placed; that is, a mounting region 37. More specifically, the ground conductor layer 36 is formed in the vicinity of the first and second feeding terminals 34 and 35, with a predetermined spacing secured therebetween. The predetermined spacing should preferably be set to fall in a range from 0.1 to 5 mm. If the spacing is smaller than 0.1 mm, in case of accidental adhesion of foreign matters such as solder during the course of the manufacture of wireless communication apparatuses, there is a risk of bringing about electrical shortings in the first and second feeding terminals 34 and 35. By way of contrast, if the spacing is larger than 5 mm, the region for forming the ground conductor layer 36 becomes small, which results in a decrease of flexibility in placement of the ground electrode 3 disposed in the surface-mount type antenna 1*a*. By securing an appropriate spacing between the ground conductor layer 36 and the first and second feeding terminal 34, 35, not only it is possible to prevent electrical shortings from occurring in the first and second feeding terminals 34 and 35, but it is also possible to increase the placement flexibility for the ground electrode 3 disposed in the surface-mount type antenna 1*a*.

In this embodiment, the first and second feeding terminals 34 and 35 each have a quadrilateral shape. The ground conductor layer 36 is arranged with its mounting-region-37-side edge located in exact alignment with the line segment connecting together the mounting-region-37-side edges of the first and second feeding terminals 34 and 35. In this way, at the time of mounting the first surface-mount type antenna la on the mounting substrate 32, the ground conductor layer 36 and the ground electrode 3 are located in the proximity of each other. This helps facilitate connection of the ground conductor layer 36 and the ground electrode 3 by means of creamy solder.

Figure 9B:
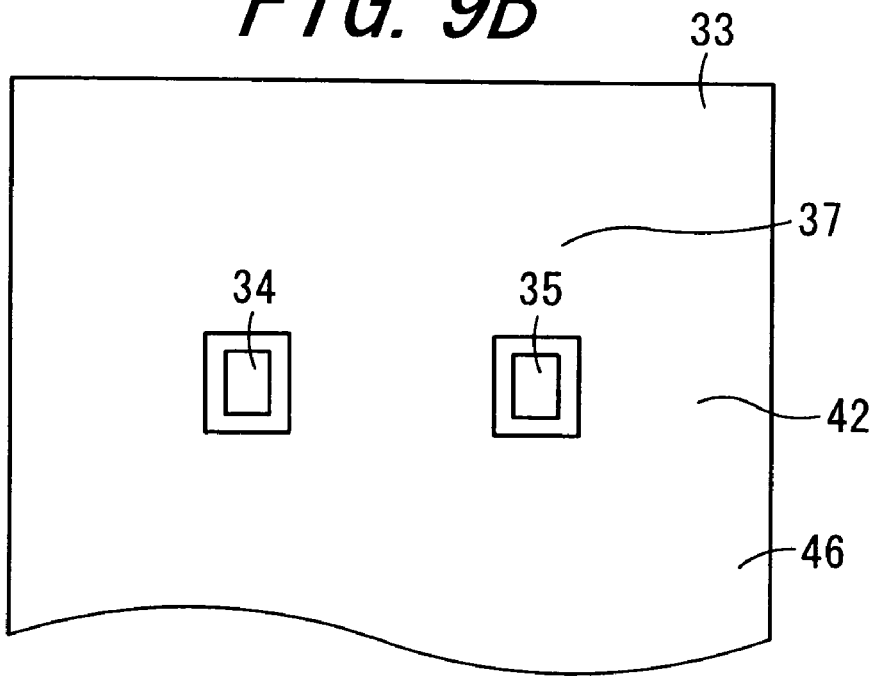

FIG. 9B is a plan view showing the mounting substrate 42. The mounting substrate 42 has basically the same structure as the mounting substrate 32 shown in FIG. 9A, the only difference being the configuration of the ground conductor layer 36. Therefore, the constituent components that play the same or corresponding roles as in FIG. 9A are identified with the same reference symbols and overlapping descriptions will be omitted. The mounting substrate 42 is composed of the tabular base plate 33; the first and second feeding terminals 34 and 35 formed on one surface of the base plate 33 as viewed in the thicknesswise direction; and the ground conductor layer 46. The ground conductor layer 46 is so formed as to surround spacedly the first and second feeding terminals 34 and 35. That is, the ground conductor layer 46 extends over the mounting region 37 on which the surface-mount type antenna 1*a* is placed. Just as is the case with the ground conductor layer 36, a predetermined spacing is secured between the ground conductor layer 46 and the first and second feeding terminal 34, 35.

The surface-mount type antenna 1*a* is stacked on the mounting substrate 42 with the first surface 11 facing with the ground conductor layer 46. Since the surface-mount type antenna 1*a* is superposed on the ground conductor layer 46 around which the first and second feeding terminals 34 and 35 are formed, the ground electrode 3 of the surface-mount type antenna 1*a* can readily be connected to the ground conductor layer 46 wherever it is arranged; that is, on any surface from the second to fifth surfaces 12, 13, 14, and 15. This helps increase the placement flexibility for the ground electrode 3.

According to such first and second antenna apparatuses 31 and 41, by virtue of the first surface-mount type antenna 1*a*, the antenna apparatus 31, 41 operates as a multiple frequency-adaptable antenna that is free from degradation of antenna characteristics caused by mutual interference between the two feeding electrodes 6 and 7 or between the two radiating electrodes 4 and 5. Another advantage is that, since the mutual interference is insignificant, one of the radiating electrodes can be subjected to open-end trimming and adjustment of the degree of capacitance coupling properly, with little influence on the other radiating electrode in terms of frequency. This makes it possible to facilitate frequency adjustment and matching control.

The first and second antenna apparatuses 31 and 41 are constructed by mounting the first surface-mount type antenna 1*a* on the mounting substrates 32 and 42, respectively. However, according to another embodiment of the invention, the antenna apparatus may be constructed by mounting one of the second to fifth surface-mount type antennas 1*b* to 1*e* on the mounting substrate 32, 42.

In this case, the first and second feeding terminals 34 and 35 need to be arranged in correspondence with the positions of the first and second feeding electrodes 6 and 7, respectively, formed in any of the second to fifth surface-mount type antennas 1*b* to 1*e*, and simultaneously the ground conductor layer 36, 46 needs to be arranged in correspondence with the position of the ground electrode 3. By doing so, it is possible to achieve the same effects as achieved in the first and second antenna apparatuses 31 and 41.

In the first to fifth surface-mount type antennas 1*a* through 1*e* of the invention, the base body 2 is made of a dielectric or magnetic material, and has a cubic shape or a rectangular parallelepiped shape. The base body 2 is manufactured by using, for example, ceramics obtained by subjecting powder, which consists of a dielectric material (relative dielectric constant $\epsilon_r$: 9.6) containing aluminum as a main component, to pressure molding and baking. Consequently, a composite material of ceramics and resin, which are dielectric materials, may be used or a magnetic material such as ferrite may be used for the base body 2.

When the base body 2 is made of a dielectric material, a propagation velocity of a high-frequency signal, which propagates the ground electrode 3, the first and second radiating electrodes 4 and 5, and the first and second feeding electrodes 6 and 7 decreases to cause reduction of a wavelength. When a relative dielectric constant of the base body 2 is assumed to be $\epsilon_r$, an effective length of conductor patterns of the ground electrode 3, the first and second radiating electrodes 4 and 5, and the first and second feeding electrodes 6 and 7 is increased by $\epsilon_r^{1/2}$ times, and the effective length becomes longer. Therefore, in the case in which pattern length of the conductor pattern is common, a region of the high electric current density in electric current distribution increases, so that it is possible to increase an amount of radio waves radiated, and it is possible to increase gain of the first to fifth surface-mount type antennas 1*a* through 1*e*.

In addition, on the contrary, in the case in which the same characteristics as the related art antenna characteristics are adopted, it is possible to make the pattern lengths of the ground electrode 3, the first and second radiating electrodes 4 and 5, and the first and second feeding electrodes 6 and 7 to be $1/\epsilon_r^{1/2}$, and it is possible to miniaturize the first to fifth surface-mount type antennas 1*a* through 1*e*.

Note that, in the case in which the base body 2 is made of a dielectric material, if the relative dielectric constant $\epsilon_r$ is lower than 3, it is close to the relative dielectric constant in the air ($\epsilon_r$=1), and there is a tendency that it is rather difficult to satisfy a market demand for miniaturization of the antenna. In addition, when the relative dielectric constant $\epsilon_r$ is more than 30, the miniaturization is possible, but the gain and bandwidth of the first to fifth surface-mount type antennas 1*a* through 1*e* become too small because the gain and bandwidth of the antenna are proportional to the size of the antenna, and there is a tendency that characteristics as a surface-mount type antenna may not be achieved. Therefore, in the case in which the base body 2 is made of a dielectric material, it is desirable to use a dielectric material with the dielectric constant $\epsilon_r$ of 3 or more and 30 or less. For such a dielectric material, for example, a ceramic material including alumina ceramics and zirconia ceramics, and a resin material including tetrafluoroethylene and glass epoxy are used.

On the other hand, when the base body 2 is made of a magnetic material, since impedances of the ground electrode 3, the first and second radiating electrodes 4 and 5, and the first and second feeding electrodes 6 and 7 increase, it is possible to decrease Q of the antenna and widen the bandwidth.

In the case in which the base body 2 is made of a magnetic material, when a relative permeability $\mu_r$ is more than 8, the bandwidth of the antenna increases, but the gain of the first to fifth surface-mount type antenna 1*a* through 1*e* becomes too small because the gain of the antenna is proportional to the size of the antenna, so that there is a tendency that characteristics as a surface-mount type antenna may not be achieved. Therefore, in the case in which the base body 2 is made of a magnetic material, it is desirable to use a magnetic material with the relative permeability $\mu_r$ of 1 or more and 8 or less. For such a magnetic material, for example, YIG (yttrium iron garnet), an Ni—Zr compound, and an Ni—Co—Fe compound are used.

The ground electrode 3, the first and second radiating electrodes 4 and 5, and the first and second feeding electrodes 6 and 7 are formed of metal containing one selected from a group consisting of, for example, aluminum, copper, nickel, silver, palladium, platinum, and gold, as a main component. In order to form respective patterns of the ground electrode 3, the first and second radiating electrodes 4 and 5, and the first and second feeding electrodes 6 and 7 with such metal, a conductor layer of desired pattern shapes only has to be formed on predetermined surface of the base body 2, by various thin film forming methods such as printing, deposition, and sputtering, a metal foil lamination method, a plating method, or the like.

A base plate 33 of mounting substrates 32 and 42 is formed of a material having an electrical isolation, such as glass epoxy, aluminum ceramics, and the like.

In addition, the ground conductor layers 36 and 46 and the feeding terminals 34 and 35 are formed of a conductor such as copper or silver that is used in a usual circuit substrate.

Note that solder mounting by a reflow furnace can be used as a method of mounting the first to fifth surface-mount type antennas 1*a* through 1*e* on the surfaces of the mounting substrates 32 and 42 and connecting the first and second feeding electrodes 4 and 5 to the first and second feeding terminals 34 and 35, and moreover connecting the ground electrode 3 to the ground conductor layers 36 and 46.

Note that, in the first to fifth surface-mount type antennas 1*a* to 1*e* of the invention, the base body 2 is not limited to the rectangular-parallelepiped configuration as illustrated in FIGS. 1A through 1E, but may be of another configuration. For example, the base body 2 may be designed to have at least one of a through hole and a groove formed in the substantially rectangular-parallelepiped basic substance thereof. Specifically, the through hole is drilled all the way through from one surface to the other surface of the base body 2 that are located in parallel with each other in the longitudinal direction X, or the transverse direction Y, or the thicknesswise direction Z. On the other hand, the groove is formed on one surface of the base body 2 so as to penetrate all the way through from one surface to the other surface thereof that are located in parallel with each other in the longitudinal direction X, or the transverse direction Y, or the thicknesswise direction Z.

Figure 10A:
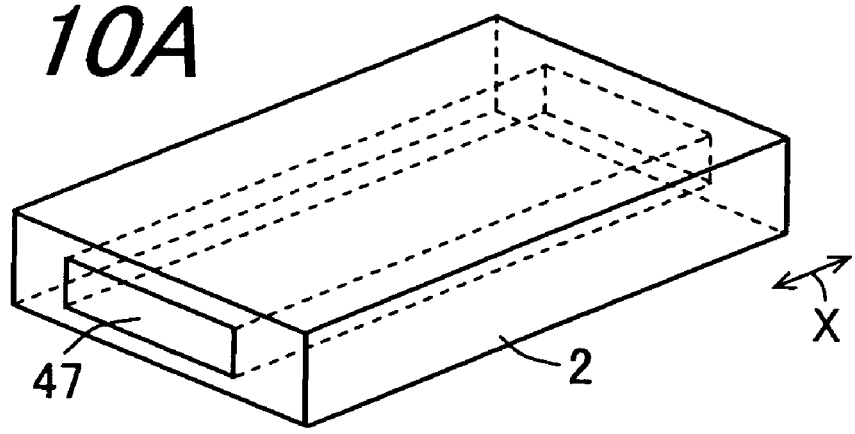
FIGS. 10A and 10B are perspective views each showing an example of a base body used in the surface-mount type antenna of the invention.

FIG. 10A is a perspective view showing the base body 2 of the type that has a through hole 47. The through hole 47 is drilled all the way through from one surface to the other surface of the base body 2 that are located in parallel with each other in a direction perpendicular to the longitudinal direction X; that is, the through hole 47 extends in the longitudinal direction X. In order to ensure sufficient mechanical strength, the configuration of the through hole 47 is so determined that the base body 2 is given a wall thickness of 0.5 mm or above. Moreover, the through hole 47 is formed in the base body 2 in a manner which does not adversely affect the antenna characteristics.

Figure 10B:
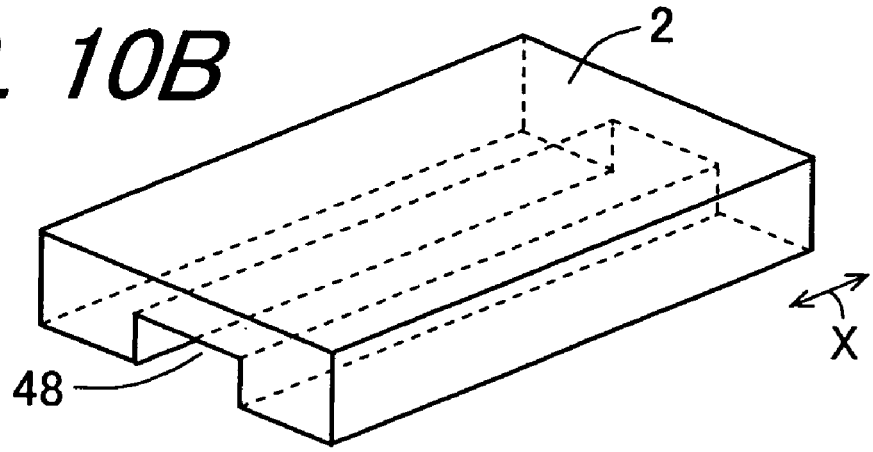

FIG. 10B is a perspective view showing the base body 2 of the type that has a groove 48. The groove 48 is formed on one surface of the base body 2 so as to penetrate all the way through from one surface to the other surface thereof that are located in parallel with each other in a direction perpendicular to the longitudinal direction X; that is, the groove 52 extends in the longitudinal direction X. In order to ensure sufficient mechanical strength, the configuration of the groove 48 is so determined that the base body 2 is given a wall thickness of 0.5 mm or above. Moreover, the groove 48 is formed in the base body 2 in a manner which does not adversely affect the antenna characteristics.

By forming the through hole 47 or the groove 48 in the base body 2 in that way, it is possible to reduce the weight of the base body 2, and thereby make the surface-mount type antenna 1 as a whole lighter in weight. It is also possible to make the surface-mount type antenna 1 highly reliable in terms of structural strength against an impact which occurs after mounting is completed.

The antenna apparatus of the invention employing the first to fifth surface-mount type antennas 1*a* through 1*e* described above is favorably used as an antenna in a radio communication apparatus adaptable to multiple frequencies. The radio communication apparatus of the invention comprises the antenna apparatus of the invention, and at least one of the transmission circuit and the reception circuit, which are connected to the antenna apparatus. In the wireless communication apparatus of the invention, by virtue of the surface-mount type antenna 1 of the invention, at the time of performing transmission or reception, there is no need to insert a switch for allowing selection between a transmission signal and a reception signal in series with the transmission path for transmission and reception signals, in consequence whereof there results no problem of signal transmission loss. In addition, a radio signal processing circuit may be connected to the surface-mount type antenna 1, the antenna apparatus, the transmission circuit, or the reception circuit in order to make it possible to perform radio communication as desired. Other various structures can be adopted.

According to such a radio communication apparatus of the invention, the radio communication apparatus includes the antenna apparatus employing the first to fifth surface-mount type antennas 1*a* through 1*e* of the invention as described above, and at least one of the transmission circuit and the reception circuit, which are connected to the antenna apparatus. Therefore, the radio communication apparatus can function as a small-sized and multiple frequency-adaptable radio communication apparatus having a small mutual interference for frequency signals, the radio communication apparatus which is adaptable to two different frequencies with one surface-mount type antenna or antenna apparatus.

Figure 11:
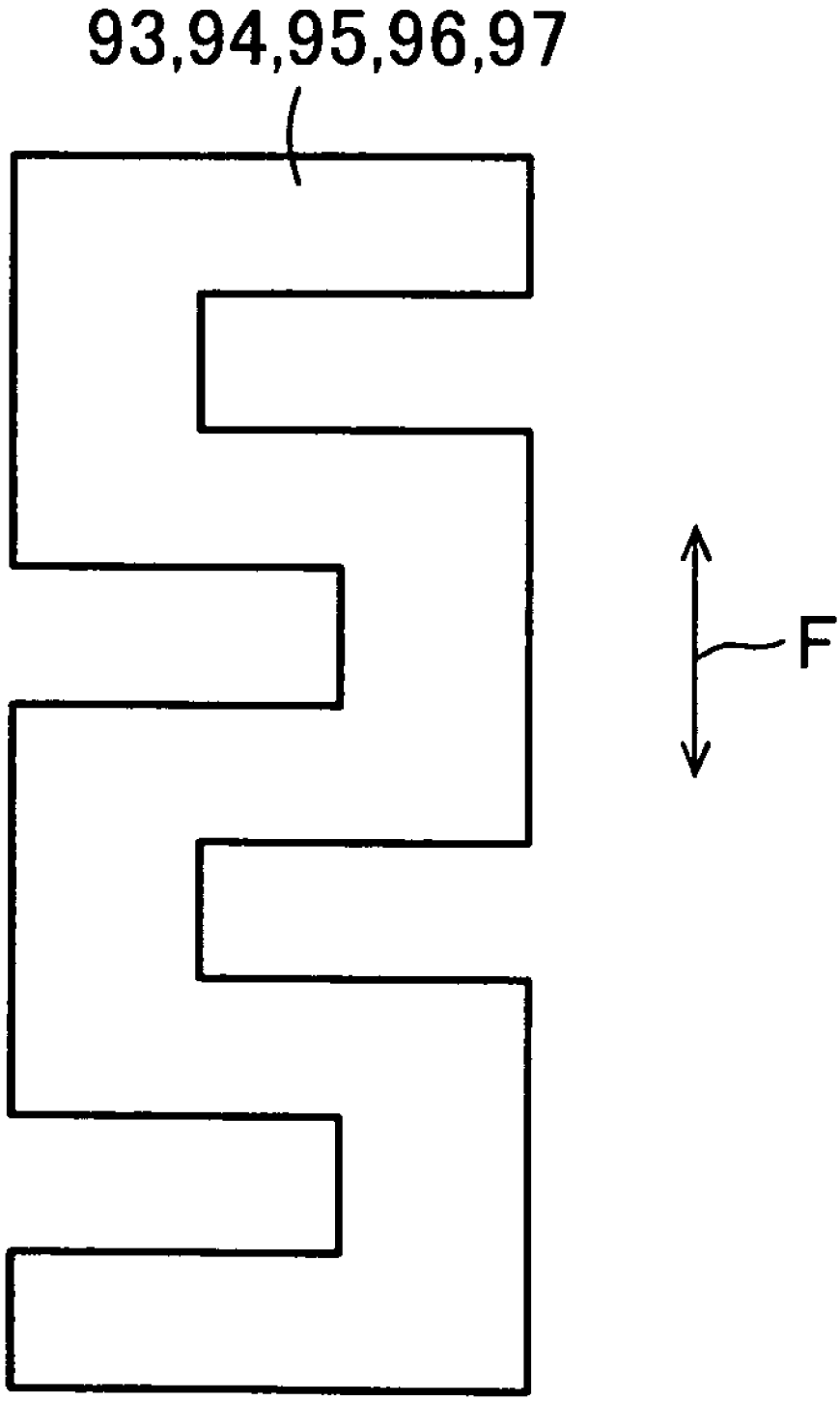
FIG. 11 is a plan view showing an example of shapes of a ground electrode, a radiating electrode, and a feeding electrode used in the surface-mount type antenna of the invention.
Figure 12:
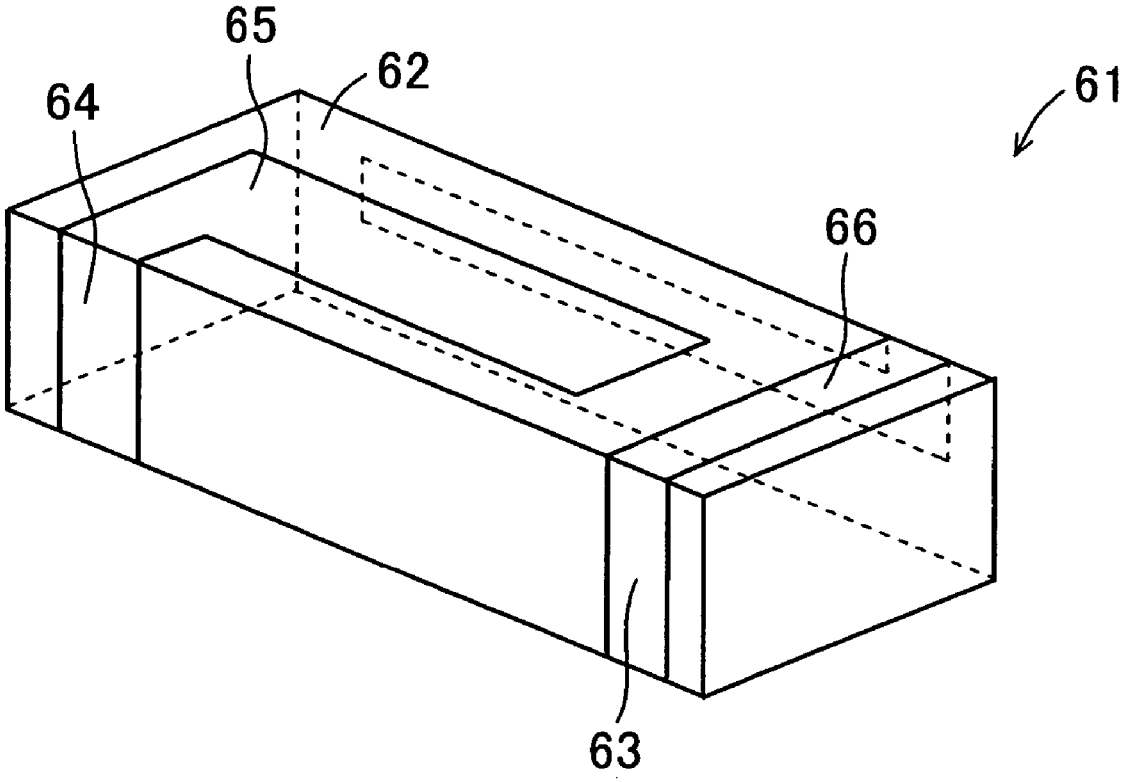
FIG. 12 PRIOR ART
FIG. 12 is a perspective view showing an example of a related art multiple frequency-adaptable surface-mount type antenna.
Figure 13:
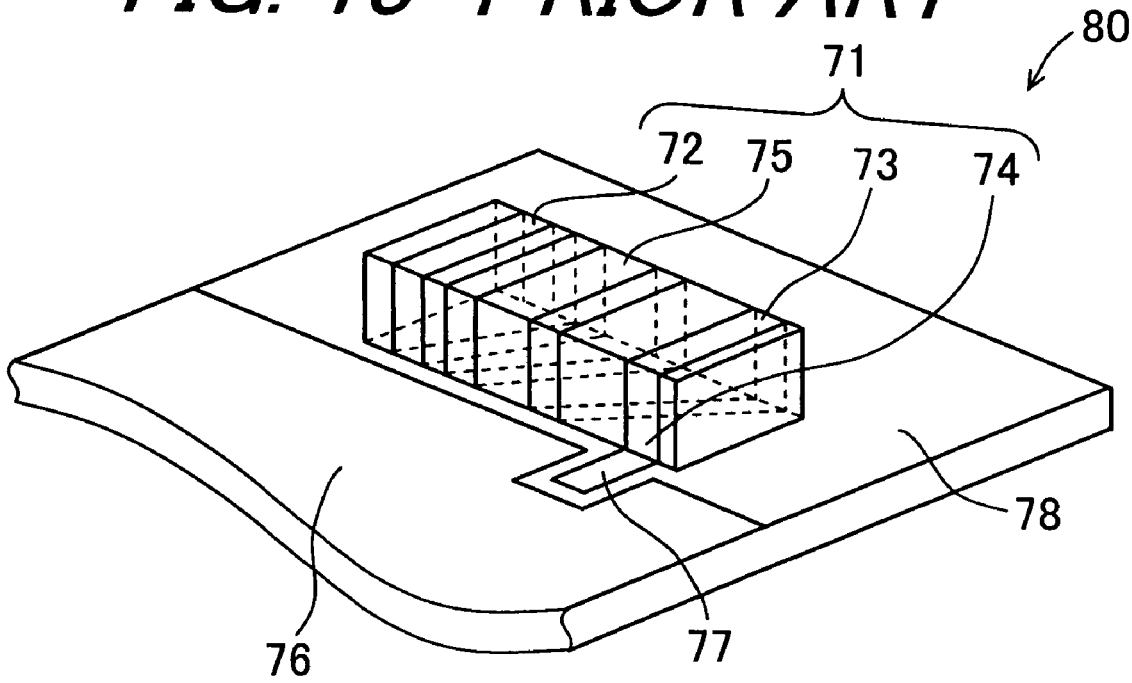
FIG. 13 PRIOR ART
FIG. 13 is a perspective view showing an example of the related art multiple frequency-adaptable surface-mount type antenna, and a an antenna apparatus employing the multiple frequency-adaptable surface-mount type antenna.
Figure 14:
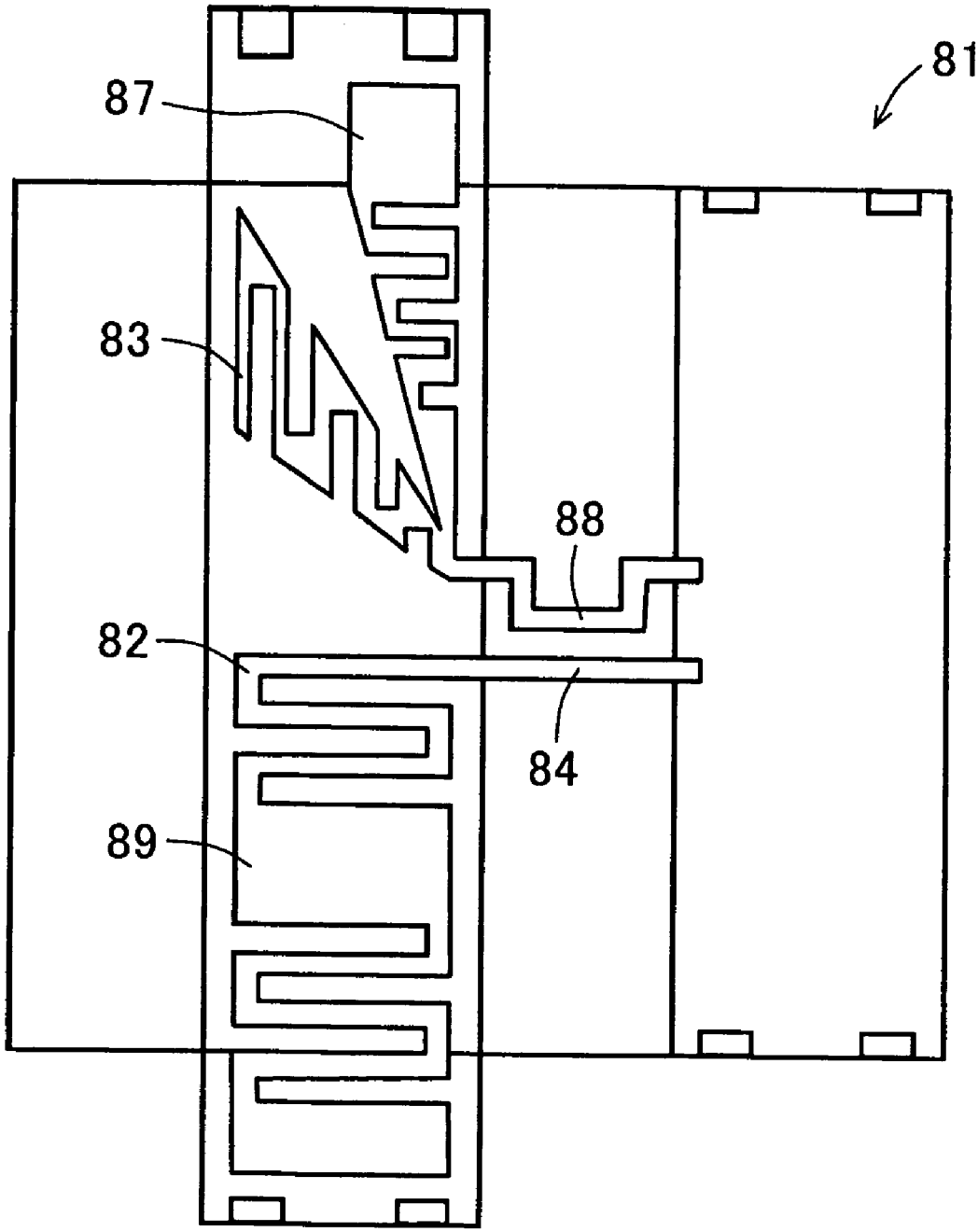
FIG. 14 PRIOR ART
FIG. 14 is a development view showing the related art multiple frequency-adaptable surface-mount type antenna.

Note that the surface-mount type antenna, the antenna apparatus, and the radio communication apparatus of the invention are not limited to the above-mentioned embodiments, and various modifications may be applied to the surface-mount type antenna, the antenna apparatus, and the radio communication apparatus within a range not departing from the scope of the invention. For example, in the first to fifth surface-mount type antennas 1*a* to 1*e* of the invention, the ground electrode 3, the first and second radiating electrodes 4 and 5, and the first and second feeding electrodes 6 and 7 are not limited to the rectangular configuration as illustrated in FIG. 1, but may be of myanda configuration as illustrated plane-wise in FIG. 11. FIG. 11 is a plan view showing the myanda configuration that applies with respect to a ground electrode 93, first and second radiating electrodes 94 and 95, and first and second feeding electrodes 96 and 97. Each of the ground electrode 93, the first and second radiating electrodes 94 and 95, and the first and second feeding electrodes 96 and 97 is elongated in an extending direction F on one surface, meandering in a direction perpendicular to the extending direction F and the one surface. Thereby, the ground electrode 93, the first and second radiating electrodes 94 and 95, and the first and second feeding electrodes 96 and 97 are made longer in electrical length. With such a serpentine configuration, in contrast to the case of forming the ground electrode 93, the first and second radiating electrodes 94 and 95, and the first and second feeding electrodes 96 and 97 in a quadrilateral shape, the surface-mount type antenna is adaptable to still lower frequencies, or can be made smaller in size.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A surface-mount type antenna comprising:

a base body, formed of a dielectric or magnetic material in the shape of a rectangular parallelepiped, having a first surface to be placed on a target substrate, and second, third, fourth, and fifth surfaces that are continuous with the first surface, and a sixth surface located in parallel with the first surface;

a ground electrode formed on, of the second to sixth surfaces of the base body, at least one of the second to fifth surfaces;

two pieces of radiating electrodes that are continuous with the ground electrode, each of which is so formed as to extend over two or more adjacent surfaces of the second to sixth surfaces; and two pieces of feeding electrodes formed on at least one of the second to fifth surfaces in such a way as to be spaced apart circumferentially of the continuum of the second to fifth surfaces to provide the ground electrode in between, the feeding electrodes being capacitance-coupled to the two radiating electrodes, respectively, for effecting feeding thereto.

2. The surface-mount type antenna of claim 1, wherein the feeding electrodes are formed on a surface of the second to fifth surfaces, on which surface the ground electrode is formed.

3. The surface-mount type antenna of claim 2, wherein the feeding electrodes are respectively arranged at both ends in opposite directions away from the ground electrode.

4. The surface-mount type antenna of claim 1, wherein the feeding electrodes are formed on different surfaces of the second to fifth surfaces that are adjacent to each other.

5. The surface-mount type antenna of claim 4, wherein the feeding electrodes are formed on different surfaces that are adjacent to each other, of which one feeding electrode is arranged at one end of its corresponding surface, the one end being non-adjacent to the surface to which the other feeding electrode belongs, and the other feeding electrode is arranged at one end of its corresponding surface, the one end being non-adjacent to the surface to which the one feeding electrode belongs.

6. The surface-mount type antenna of claim 1, wherein the feeding electrodes are formed on different surfaces of the second to fifth surfaces that confront each other in a direction longitudinally of the base body.

7. The surface-mount type antenna of claim 1, wherein the feeding electrodes are formed on different surfaces of the second to fifth surfaces that are parallel to each other in such a manner as not to confront each other.

8. The surface-mount type antenna of claim 1, wherein the two radiating electrodes have free ends thereof which are opposed to each other.

9. The surface-mount type antenna of claim 1, wherein the two radiating electrodes have free ends thereof opposed to each other, in such a way as to be spaced apart to provide the ground electrode in between.

10. The surface-mount type antenna of claim 1, wherein, of the two radiating electrodes, one radiating electrode has its free end placed on one of the two parallely-arranged surfaces of the second to fifth surfaces, and the other radiating electrode has its free end placed on the other one of the two parallely-arranged surfaces.

11. The surface-mount type antenna of claim 1, wherein the base body has at least one of a through hole and a groove formed therein.

12. An antenna apparatus comprising:

the surface-mount type antenna of claim 1; and a mounting substrate, made of a basic substance possessing an electrical insulation property, having two feeding terminals and a ground conductor layer formed on a top surface of the basic substance, the two feeding terminals being placed in correspondence with the positions of the two feeding electrodes of the surface-mount type antenna, respectively, and the ground conductor layer being arranged on one side of the top surface opposite to the other side thereof on which the surface-mount type antenna is mounted, namely, a mounting region, in the vicinity of the two feeding terminals, with a spacing secured between the ground conductor layer and the feeding terminals, wherein the antenna apparatus is constructed by mounting the surface-mount type antenna mentioned aboveon the mounting substrate with the first surface of the surface-mount type antenna facing with the mounting region, with the two feeding electrodes connected to their corresponding feeding terminals, and with the ground electrode connected to the ground conductor layer.

13. A wireless communication apparatus comprising:

the antenna apparatus of claim 12; and at least one of a transmission circuit and a reception circuit designed for radio signals in a desired range of frequencies, the transmission circuit and/or the reception circuit being connected to the two feeding terminals.

14. An antenna apparatus comprising:

the surface-mount type antenna of claim 1; and a mounting substrate, made of a basic substance possessing an electrical insulation property, having two feeding terminals and a ground conductor layer formed on a top surface of the basic substance, the two feeding terminals being placed in correspondence with the positions of the two feeding electrodes of the surface-mount type antenna, respectively, and the ground conductor layer being formed so as to surround spacedly the two feeding terminals, wherein the antenna apparatus is constructed by stacking the surface-mount type antenna mentioned above on the mounting substrate with the first surface of the surface-mount type antenna facing with the ground conductor layer, with the two feeding electrodes connected to their corresponding feeding terminals, and with the ground electrode connected to the ground conductor layer.

15. A wireless communication apparatus comprising:

the antenna apparatus of claim 14; and at least one of a transmission circuit and a reception circuit designed for radio signals in a desired range of frequencies, the transmission circuit and/or the reception circuit being connected to the two feeding terminals.

* * * * *